US006181317B1

(12) United States Patent
Taguchi et al.

(10) Patent No.: US 6,181,317 B1
(45) Date of Patent: Jan. 30, 2001

(54) DISPLAY AND METHOD OF AND DRIVE CIRCUIT FOR DRIVING THE DISPLAY

(75) Inventors: Yoshihisa Taguchi; Katsunori Tanaka; Katsuhiko Kishida; Tosiya Onodera; Hirofumi Miyamoto; Mikio Oshio; Tsutomu Kai; Masanori Nakamura, all of Kawasaki (JP)

(73) Assignee: Fujitsu Limited, Kawasaki (JP)

( * ) Notice: Under 35 U.S.C. 154(b), the term of this patent shall be extended for 0 days.

(21) Appl. No.: 08/738,033

(22) Filed: Oct. 24, 1996

(30) Foreign Application Priority Data

May 9, 1996 (JP) ..... 8-114831

(51) Int. Cl.[7] ..... G09G 5/00
(52) U.S. Cl. ..... 345/132; 345/99; 348/556
(58) Field of Search ..... 345/132, 87, 92, 345/127, 99, 212, 213, 100; 348/556, 554, 553, 913, 445, 435

(56) References Cited

U.S. PATENT DOCUMENTS

| | | | | |
|---|---|---|---|---|
| 4,843,381 | * | 6/1989 | Baron | 340/784 |
| 5,227,882 | * | 7/1993 | Kato | 358/160 |
| 5,347,318 | * | 9/1994 | Kobayashi et al. | 348/556 |
| 5,353,065 | * | 10/1994 | Katsumata et al. | 348/556 |
| 5,416,598 | * | 5/1995 | Ezaki | 358/310 |
| 5,510,847 | * | 4/1996 | Nio et al. | 348/554 |
| 5,629,744 | * | 5/1997 | Kawamura | 348/792 |
| 5,638,485 | * | 6/1997 | Kobayashi et al. | 386/123 |
| 5,739,804 | * | 4/1998 | Okumura et al. | 345/99 |
| 5,844,538 | * | 12/1998 | Shiraki et al. | 349/139 |

FOREIGN PATENT DOCUMENTS

| | | |
|---|---|---|
| 1-170985 | 7/1989 | (JP) . |
| 6-161409 | 6/1994 | (JP) . |
| 6-167953 | 6/1994 | (JP) . |
| 6-259049 | 9/1994 | (JP) . |
| 7-261705 | 10/1995 | (JP) . |

* cited by examiner

*Primary Examiner*—Vijay Shankar
*Assistant Examiner*—Mansour M. Said
(74) *Attorney, Agent, or Firm*—Greer, Burns & Crain. Ltd.

(57) ABSTRACT

A display has a display panel of a first aspect ratio and is able to display on the display panel an image of a second aspect ratio whose width element is larger than that of the first aspect ratio. The display has a gate driver, a data driver, and a timing controller. The gate driver sequentially selects gate lines of the display panel. The data driver stores data for one gate line and supplies the data to one of the gate lines selected by the gate driver. The timing controller supplies control signals to the gate and data drivers so that predetermined data is displayed in top and bottom non-image areas of the display panel during a vertical blanking period. The display is capable of displaying images of different sizes.

22 Claims, 50 Drawing Sheets

DISPLAY AND METHOD OF AND DRIVE CIRCUIT FOR DRIVING THE DISPLAY

BACKGROUND OF THE INVENTION

1. Field of the Invention

The present invention relates to a display and a method of and a drive circuit for driving the display, more particularly to a liquid crystal display (LCD) and a method of and a drive circuit for driving the same.

2. Description of the Related Art

Recently, thin displays are widely used not only for notebook-type personal computers and notebook-type word processors, but also for normal- and wide-screen television units. It is required to provide a display capable of displaying images of different sizes.

Namely, recent computers and video equipment provide fine, high-quality images, and displays such as LCDs are required to display such images and images of different sizes.

To display fine, high-quality images, a display, for example, a matrix LCD must have many pixels. A color image of 640×480 dots requires 640×480×3 (for red, green, and blue) pixels, and a color image of 1024×768 dots requires 1024×768×3 pixels. An LCD designed for 640×480-dot images is improper to display 1024×768-dot images, and an LCD designed for 1024×768-dot images is improper to display 640×480-dot images.

Another requirement for LCDs is to display normal television images of 3:4 in aspect ratio as well as wide television images of 9:16 in aspect ratio. Further, improvements in multimedia technology ask one LCD to display images of various sizes.

The problems of the prior art will be explained later in detail with reference to the accompanying drawings.

SUMMARY OF THE INVENTION

An object of the present invention is to provide a display capable of properly displaying images of various sizes.

According to the present invention, there is provided a display comprising a display panel having a first aspect ratio, capable of displaying an image of a second aspect ratio whose width element is larger than that of the first aspect ratio; a gate driver for sequentially selecting gate lines of the display panel; a data driver for storing display data for one gate line and supplying the display data to one of the gate lines selected by the gate driver; and a timing controller for supplying control signals to the gate driver and the data driver so that predetermined data is displayed in top and bottom non-image areas of the display panel during a vertical blanking period.

A frequency of a clock signal used to sequentially select the gate lines may be increased during the vertical blanking period from a value for usual display data to a value for the predetermined data. A frequency of the clock signal for the predetermined data may be about two to four times higher than a frequency for usual display data. The timing controller may write the predetermined data simultaneously to the top and bottom non-image areas of the display panel during the vertical blanking period with the frequency of the clock signal being set to a low value. The timing controller may write the predetermined data to the data driver during the vertical blanking period in one latch operation. The first aspect ratio may be 3:4 corresponding to a normal-size image, and the second aspect ratio may be 9:16 corresponding to a wide-size image.

The display may further comprise an RGB driver for controlling red, green, and blue. The predetermined data may correspond to black. The display may be a liquid crystal display.

Further, according to the present invention, there is provided a display comprising a display panel of a first aspect ratio, capable of displaying an image of a second aspect ratio whose height element is larger than that of the first aspect ratio; a gate driver for sequentially selecting gate lines of the display panel; a data driver for storing display data for one gate line and supplying the stored display data to one of the gate lines selected by the gate driver; and a timing controller for supplying control signals to the gate driver and the data driver so that predetermined data is displayed in left and right non-image areas of the display panel during a horizontal blanking period.

The first aspect ratio may be 9:16 corresponding to a wide-size image and the second aspect ratio may be 3:4 corresponding to a normal-size image. The timing controller may write the predetermined data simultaneously to the left and right non-image areas of the display panel during the horizontal blanking period with the frequency of the clock signal being set to a low value. The timing controller may write the predetermined data simultaneously to the right non-image area of a given gate line and the left non-image area of the next gate line during the horizontal blanking period. The display may be capable of inverting an image according to data start signals.

Further, according to the present invention, there is provided a display comprising a display panel having a matrix of pixels, capable of displaying an image including a smaller number of dots than the number of pixels of the display panel; a gate driver for sequentially selecting gate lines of the display panel; a data driver for storing display data for one gate line and supplying the stored display data to one of the gate lines selected by the gate driver; and a timing controller for supplying control signals to the gate driver and the data driver so that gate lines having no image data are driven at intervals of several gate lines during a horizontal period and so that different ones of the gate lines having no image data are driven from frame to frame so that all gate lines are driven in several frames.

The gate driver may comprise a first and a second gate drivers arranged on each side of the display panel, to alternately drive the gate lines. The timing controller may have a clock generator for generating clock pulses having different frequencies and a clock controller for generating select signals to select one of the clock pulses as a gate shifting clock signal. The timing controller may drive the gate lines having no image data at intervals of several gate lines according to the first clock pulse selected by the select signal and may skip the remaining gate lines that are not driven according to the second clock pulse selected by the select signal, the period of the second clock pulse being shorter than that of the first clock pulse.

The polarity of a drive signal applied to the gate lines having no image data may be alternated whenever all gate lines are driven. The display may further comprise an image signal controller for controlling display data. The predetermined data may correspond to black.

According to the present invention, there is also provided a drive circuit of a display having a display panel of a first aspect ratio, capable of displaying an image of a second aspect ratio whose width element is larger than that of the first aspect ratio, a gate driver for sequentially selecting gate lines of the display panel, and a data driver for storing display data for one gate line and supplying the stored display data to one of the gate lines selected by the gate driver, comprising the function of supplying control signals to the gate driver and the data driver so that predetermined data is displayed in top and bottom non-image areas of the display panel during a vertical blanking period.

Further, according to the present invention, there is provided a drive circuit of a display having a display panel of a first aspect ratio, capable of displaying an image of a second aspect ratio whose height element is larger than that of the first aspect ratio, a gate driver for sequentially selecting gate lines of the display panel, and a data driver for storing display data for one gate line and supplying the stored display data to one of the gate lines selected by the gate driver, comprising the function of supplying control signals to the gate driver and the data driver so that predetermined data is displayed in left and right non-image areas of the display panel during a horizontal blanking period.

Further, according to the present invention, there is provided a drive circuit of a display having a display panel having a matrix of pixels, capable of displaying an image including a smaller number of dots than the number of pixels of the display panel, a gate driver for sequentially selecting gate lines of the display panel, and a data driver for storing display data for one gate line and supplying the stored display data to one of the gate lines selected by the gate driver, comprising the function of supplying control signals to the gate driver and the data driver so that gate lines having no image data are driven at intervals of several gate lines during a horizontal period and so that different ones of the gate lines having no image data are driven from frame to frame so that all gate lines are driven in several frames.

Further, according to the present invention, there is also provided a method of driving a display having a display panel of a first aspect ratio, to display on the display panel an image of a second aspect ratio whose width element is larger than that of the first aspect ratio, comprising the steps of writing predetermined data; and displaying the predetermined data written to the data driver in top and bottom non-image areas of the display panel during a vertical blanking period.

The method may further comprise the step of increasing, during the vertical blanking period, the frequency of a clock signal used to write display data from a value for usual display data to a value for the predetermined data. The frequency for the predetermined data may be about two to four times higher than the frequency for usual display data. The method may further comprise the step of writing the predetermined data simultaneously to the top and bottom non-image areas of the display panel during the vertical blanking period with the frequency of the clock signal being set to a low value.

The step of writing the predetermined data to a data driver during the vertical blanking period may be carried out in one latch operation.

In addition, according to the present invention, there is provided a method of driving a display having a display panel of a first aspect ratio, to display on the display panel an image of a second aspect ratio whose height element is larger than that of the first aspect ratio, comprising the steps of writing predetermined data; and displaying the predetermined data in left and right non-image areas of the display panel during a horizontal blanking period.

The method may further comprise the step of increasing, during the horizontal blanking period, the frequency of a clock signal used to write display data from a value for usual display data to a value for the predetermined data.

Further, according to the present invention, there is also provided a method of driving a display having a display panel having a matrix of pixels, to display on the display panel an image including a smaller number of dots than the number of pixels of the display panel, comprising the steps of driving gate lines having no image data at intervals of several gate lines during a horizontal period; and changing the gate lines having no image data to be driven from frame to frame so that all gate lines are driven in several frames.

The method may further comprise the steps of driving the gate lines having no image data at intervals of several gate lines according to a first clock pulse selected by a select signal; and skipping the remaining gate lines that are not driven, according to a second clock pulse selected by a select signal, the period of the second clock pulse being shorter than that of the first clock pulse. The method may further comprise the step of alternating the polarity of a drive signal applied to the gate lines having no image data whenever all gate lines are driven.

BRIEF DESCRIPTION OF THE DRAWINGS

The present invention will be more clearly understood from the description of the preferred embodiments as set forth below with reference to the accompanying drawings, in which.

DESCRIPTION OF THE PREFERRED EMBODIMENTS

For a better understanding of the preferred embodiments of the present invention, the problem in the prior art will be explained with reference to FIGS. 1A to 2B.

Figure 1A:
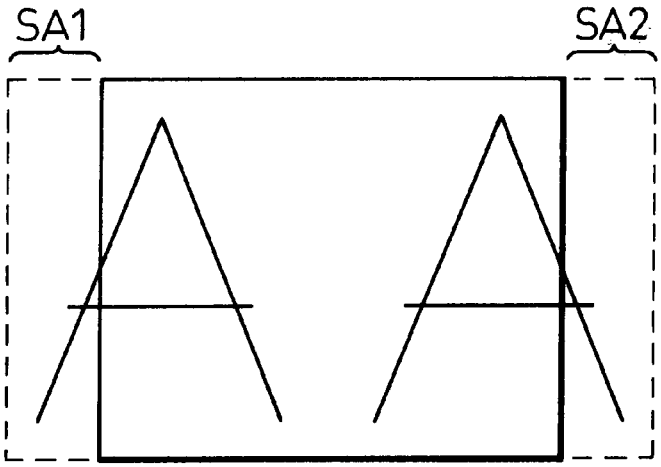
Fig.1A (PRIOR ART)
FIGS. 1A and 1B show images displayed according to a prior art.
Figure 1B:
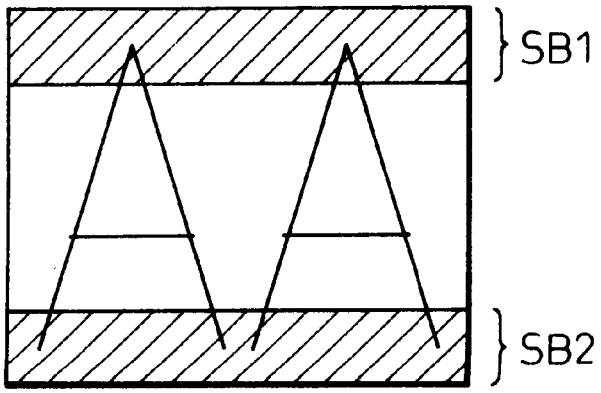
Fig.1B (PRIOR ART)
Figure 2A:
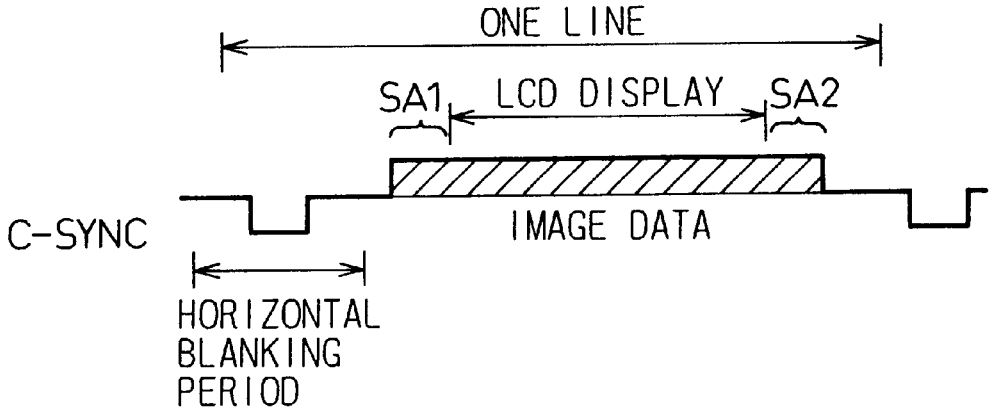
Fig.2A (PRIOR ART)
FIGS. 2A and 2B show methods to display the images of FIGS. 1A and 1B according to the prior art.
Figure 2B:
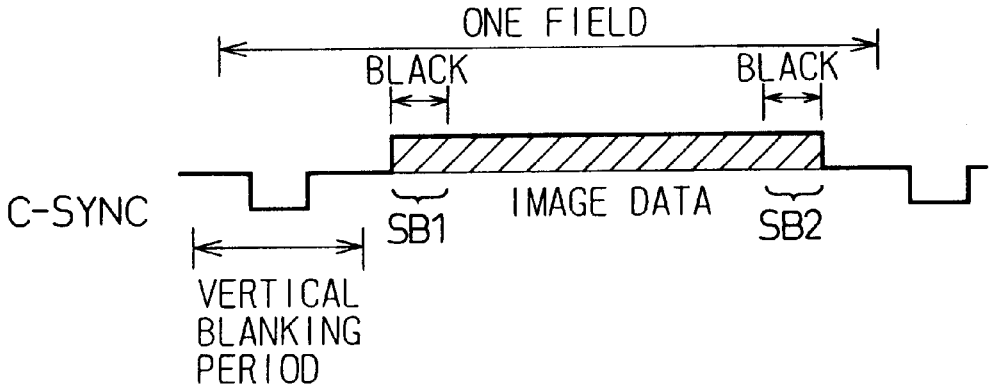
Fig.2B (PRIOR ART)

FIGS. 1A and 1B show wide images displayed on a display such as a liquid crystal display (LCD) according to the prior art. The display is designed for normal-size images. FIGS. 2A and 2B show methods of the prior art to display the images of FIGS. 1A and 1B.

The LCD of the prior art has a normal aspect ratio of 3:4. When a wide image having an aspect ratio of 9:16 is displayed on the LCD, the prior art cuts left and right areas of the image as shown in FIG. 1A, or top and bottom areas thereof as shown in FIG. 1B.

To display the image of FIG. 1A, the method of FIG. 2A cuts left and right areas SA1 and SA2 of each line of the wide image and displays only an intermediate part of 3:4 in aspect ratio of the wide image. Namely, this method is unable to display the areas SA1 and SA2 of the wide image.

On the other hand, the method of FIG. 2B cuts top and bottom areas SB1 and SB2 of the wide image and displays only an intermediate area of 3:4 in aspect ratio of the wide image. At this time, this method displays black in the areas SB1 and SB2.

In this way, the conventional LCD designed for normal images is unable to properly display wide images or images of various sizes.

Next, preferred embodiments of the present invention will be explained.

Figure 3:
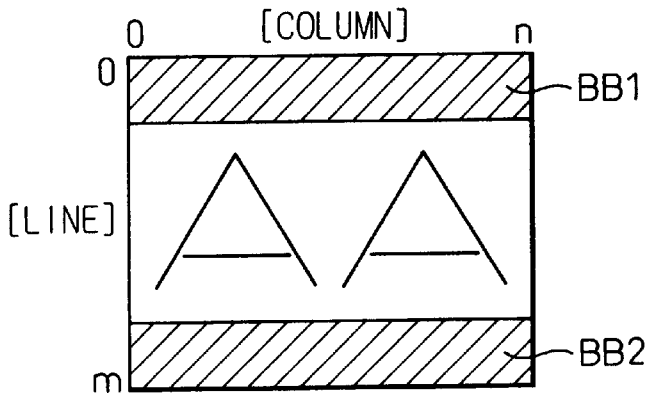
FIG. 3 shows an image displayed according to a first aspect of the present invention.

FIG. 3 shows a wide image displayed in its original aspect ratio on an LCD according to the first aspect of the present invention. The LCD has an LCD panel having n data lines and m gate lines (horizontal scan lines). The LCD displays, for example, black in top and bottom areas BB1 and BB2 where no image data is given.

Figure 4:
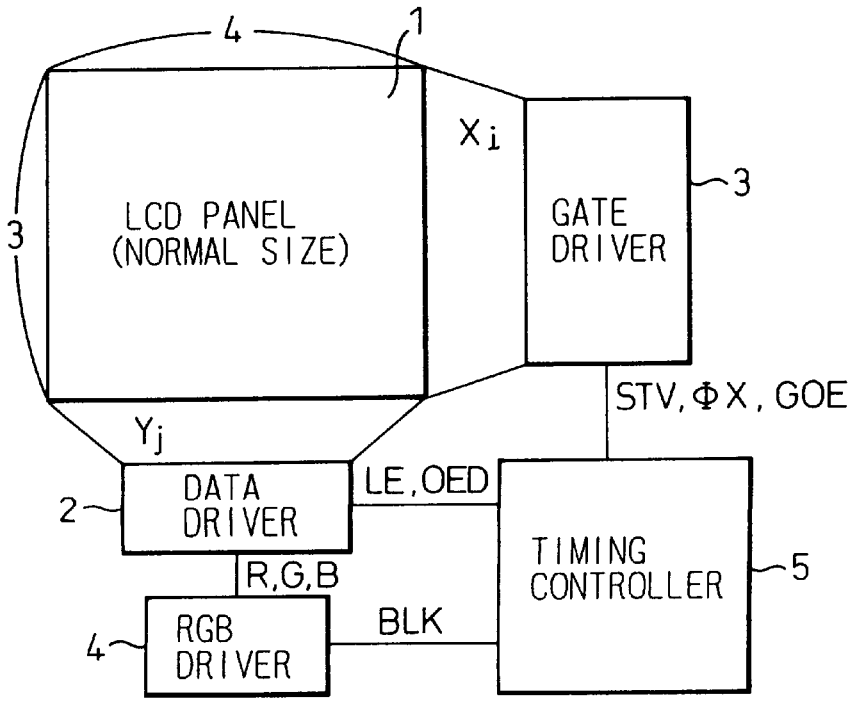
FIG. 4 is a block diagram showing an LCD according to an embodiment of the first aspect of the present invention.

FIG. 4 is a block diagram showing an LCD according to an embodiment of the first aspect of the present invention. The LCD has an LCD panel 1, a data driver 2, a gate driver 3, an RGB driver (image signal processor) 4, and a timing controller (control signal generator) 5.

The LCD panel 1 has an aspect ratio of 3:4. The data driver 2 stores display data for one gate line. The gate driver 3 sequentially selects the gate lines of the panel 1, and data stored in the data driver 2 is supplied to the selected gate line, to display an image on the panel 1.

The timing controller 5 provides the gate driver 3 with a vertical start signal STV, a gate shifting clock signal $\phi X$, and a gate output enable signal GOE. The timing controller 5 provides the data driver 2 with a data latch enable signal LE and a data output enable signal OED. Further, the timing controller 5 provides the RGB driver 4 with a black control signal BLK. The RGB driver 4 provides the data driver 2 with red (R), green (G), and blue (B) data signals.

Figure 5:
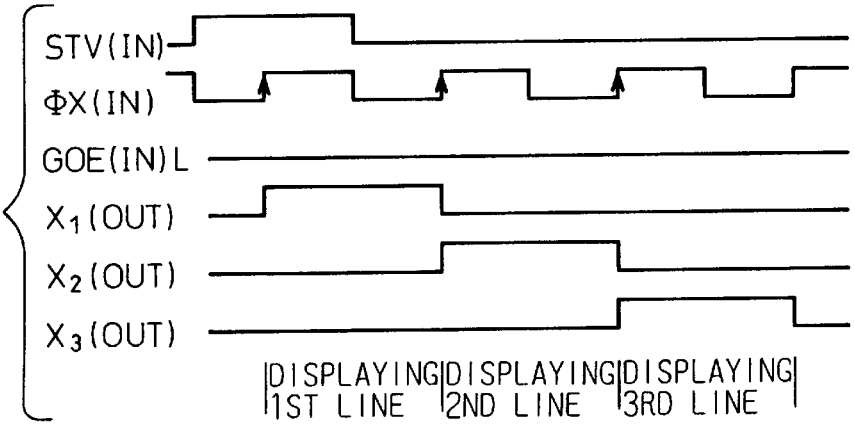
FIG. 5 is a timing chart showing the operation of a gate driver of the LCD of FIG. 4.

FIG. 5 is a timing chart showing the operation of the gate driver 3 when displaying a normal image of 3:4 in aspect ratio on the panel 1.

After the start signal STV rises, the gate driver 3 sequentially selects a first gate line X1(OUT), a second gate line X2(OUT), a third gate line X3(OUT), and the like in response to each rise of the clock signal $\phi X$. The data driver 2 writes display data to the selected gate line, thereby displaying an image on the panel 1.

Figure 6:
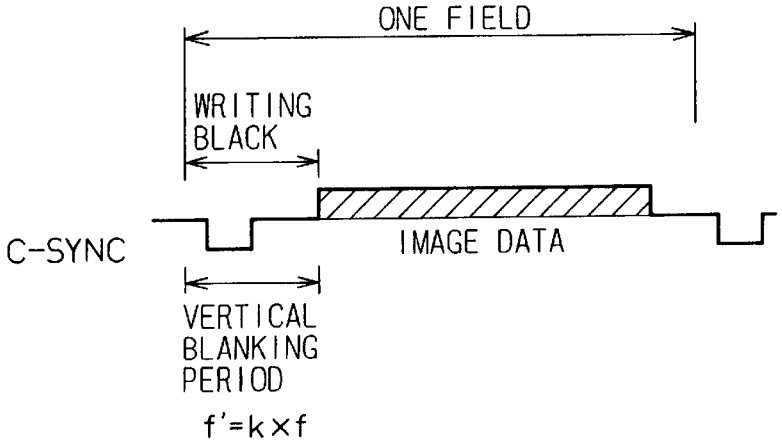
FIG. 6 shows a method of controlling the LCD of FIG. 4.

FIG. 6 shows a method of controlling the LCD of FIG. 4 according to the first aspect of the present invention.

The first aspect displays, during a vertical blanking period, a specific color such as black in the areas BB1 and BB2 having no image data.

It is impossible to entirely display black in the areas BB1 and BB2 during a vertical blanking period at the driving frequency f Hz of the panel 1. Accordingly, the first aspect multiplies the frequency f of the clock signal $\phi X$ supplied to the gate driver 3 during the vertical blanking period by k ($f'=f\times k$). The constant k is, for example, 2 to 4 so that black is written to the areas BB1 and BB2 at the frequency f' that is faster than the driving frequency f of the panel 1.

Figure 7:
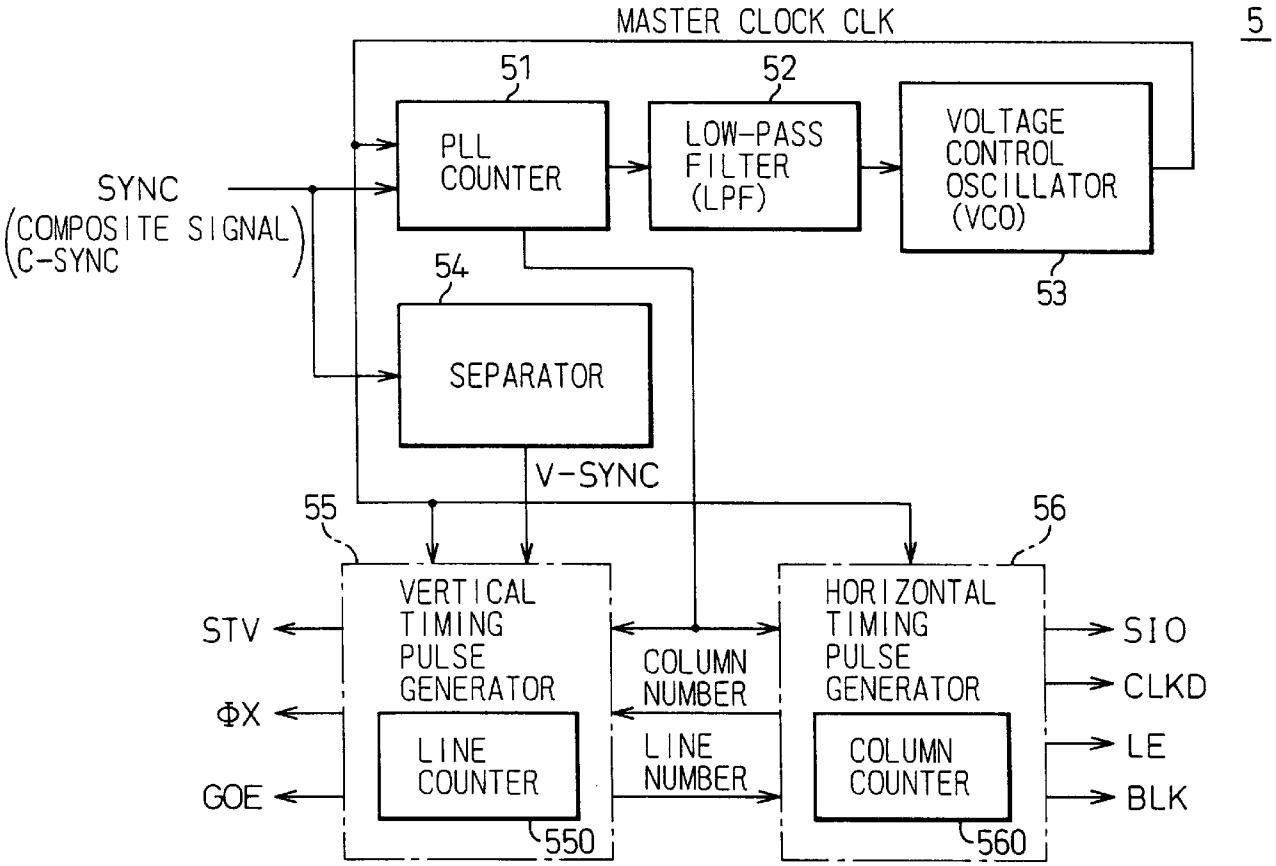
FIG. 7 is a block diagram showing a timing controller of the LCD of FIG. 4.

FIG. 7 is a block diagram showing the timing controller 5. The timing controller 5 has a PLL (phase locked loop) counter 51, a low-pass filter (LPF) 52, a voltage control oscillator (VCO) 53, a separator 54, a vertical timing pulse generator 55, and a horizontal timing pulse generator 56.

In response to a composite signal C-SYNC, the separator 54 supplies a vertical synchronizing signal V-SYNC to the vertical timing pulse generator 55. The composite signal C-SYNC is also supplied to the PLL counter 51. The output of the PLL counter 51 is fed back thereto through the low-pass filter 52 and voltage control oscillator 53, which provides a master clock signal CLK. The master clock signal CLK and the output of the PLL counter 51 are supplied to the vertical and horizontal timing pulse generators 55 and 56.

The vertical timing pulse generator 55 has a line counter 550, to provide the horizontal timing pulse generator 56 with a line number. The horizontal timing pulse generator 56 has a column counter, to provide the vertical timing pulse generator 55 with a column number. The vertical timing pulse generator 55 generates the vertical start signal STV, gate shifting clock signal $\phi X$, and gate output enable signal GOE. The horizontal timing pulse generator 56 generates a horizontal start signal SIO, a data shifting clock signal CLKD, and the data output enable signal OED.

Figure 8:
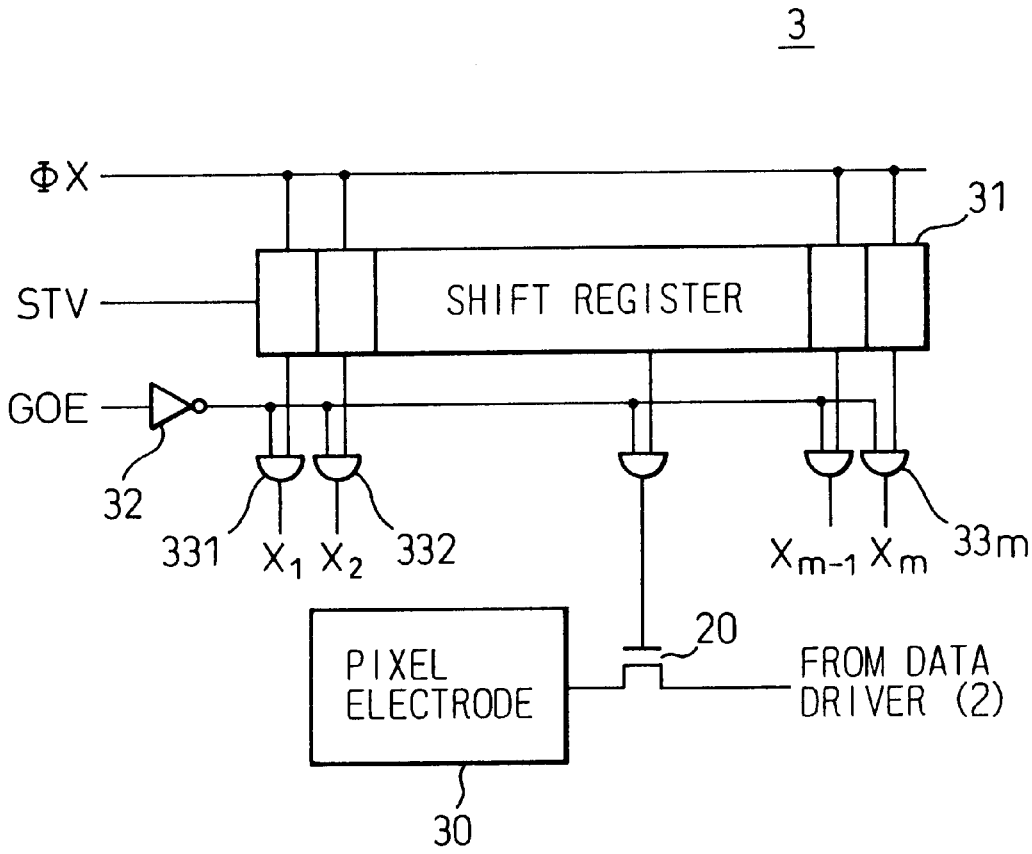
FIG. 8 is a block diagram showing the gate driver of the LCD of FIG. 4.

FIG. 8 is a block diagram showing the gate driver 3 of the LCD of FIG. 4. The gate driver 3 has a shift register 31, an inverter 32, and AND gates 331 to 33*m*.

Each register unit of the shift register 31 receives the clock signal $\phi X$. In addition, the first register unit receives the start signal STV. An input terminal of each of the AND gates 331 to 33*m* receives the output enable signal GOE through the inverter 32, and the other input terminal thereof receives the output of a corresponding one of the register units of the shift register 31. The signal GOE is set at low level, and therefore, the input terminal of each AND gate connected to the inverter 32 is at high level. Consequently, the outputs X1 to Xm of the AND gates 331 to 33*m* are equal to the outputs of the register units of the shift register 31. In response to the start signal STV, the gate outputs X1 to Xm are sequentially selected according to the clock signal $\phi X$. The selected gate output is supplied to the gates of TFTs 20 connected to pixel electrodes 30 arranged along one gate line of the panel 1. Display data is written to the gate line in question. The present invention is applicable not only to active-matrix LCDs but also to other displays such as plasma display panels (PDPs).

Figure 9:
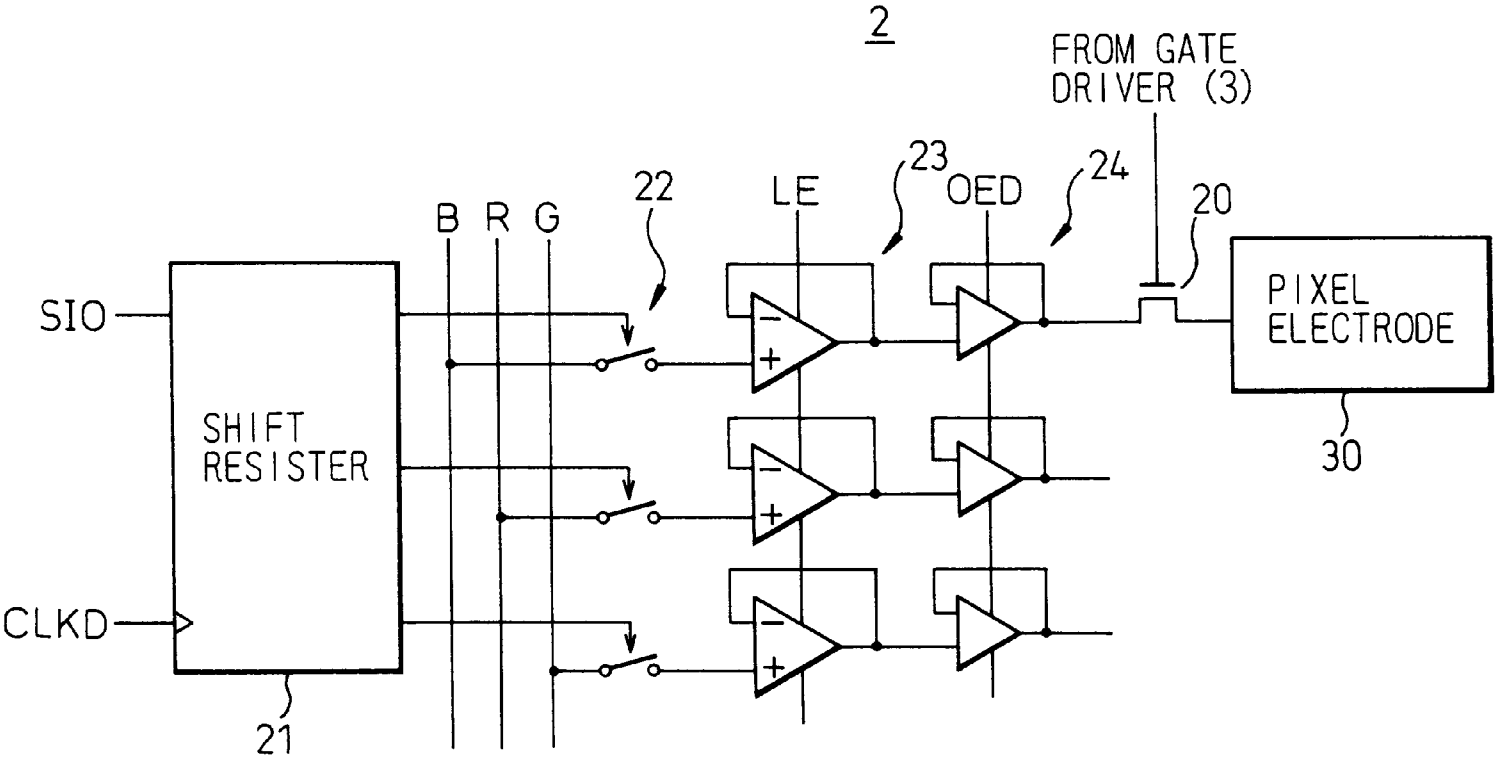
FIG. 9 is a block diagram showing a data driver of the LCD of FIG. 4.

FIG. 9 is a block diagram showing the data driver 2 of the LCD of FIG. 4. The data driver 2 has a shift register 21, a switching circuit 22, a latch circuit 23, and an output circuit 24.

The shift register 21 receives the start signal SIO and data shifting clock signal CLKD. The circuits 22, 23, and 24 are arranged for each of red (R), green (G), and blue (B). The outputs of the shift register 21 controls the switching circuit 22. The latch enable signal LE controls the latch circuit 23, and the output enable signal OED controls the output circuit 24. The output of the output circuit 24 is connected to the source of a corresponding TFT 20 whose drain is connected to a corresponding pixel electrode 30. R, G, and B data for one gate line are written to pixels that are arranged along a gate line selected by the gate driver 3.

Figure 10:
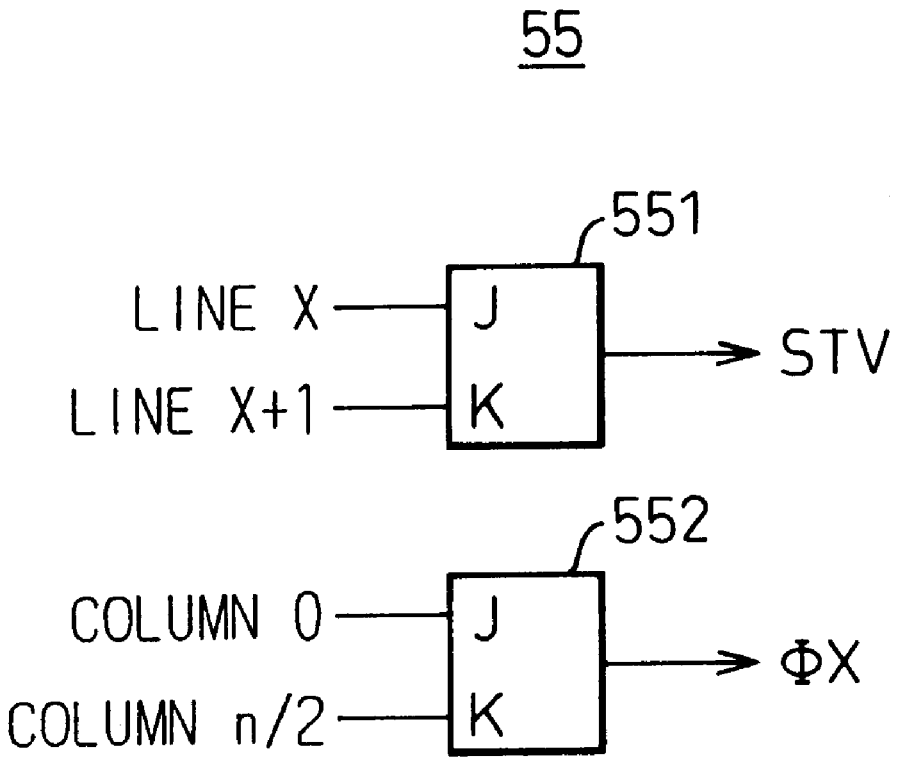
FIG. 10 shows a vertical timing pulse generator of the timing controller of FIG. 7, for generating signals of FIG. 5.

FIG. 10 shows an example of the vertical timing pulse generator 55 of FIG. 7.

The vertical timing pulse generator 55 has two J–K flip-flops 551 and 552. J and K terminals of the flip-flop 551 receive X-line and X+1-line select signals, respectively, so that the flip-flop 551 may provide the vertical start signal STV. J and K terminals of the flip-flop 552 receive a 0-column and n/2-column select signals, respectively, so that the flip-flop 552 may provide the gate shifting clock signal $\phi X$.

Figure 11:
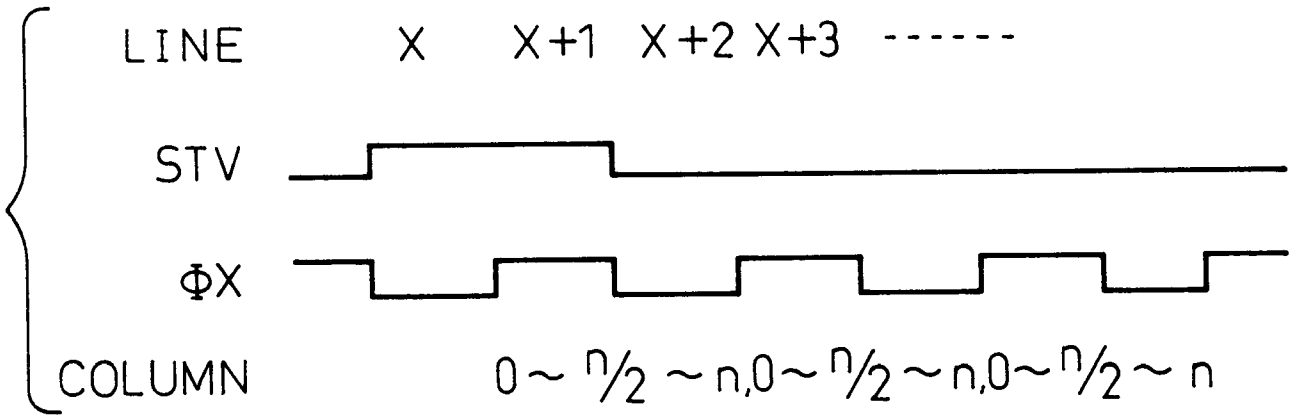
FIG. 11 is a timing chart showing the operation of the generator of FIG. 10.

FIG. 11 is a timing chart showing the operation of the vertical timing pulse generator 55 of FIG. 10. The flip-flop 551 provides the start signal STV, and the flip-flop 552 provides the clock signal $\phi X$ as shown in the figure.

Figure 12:
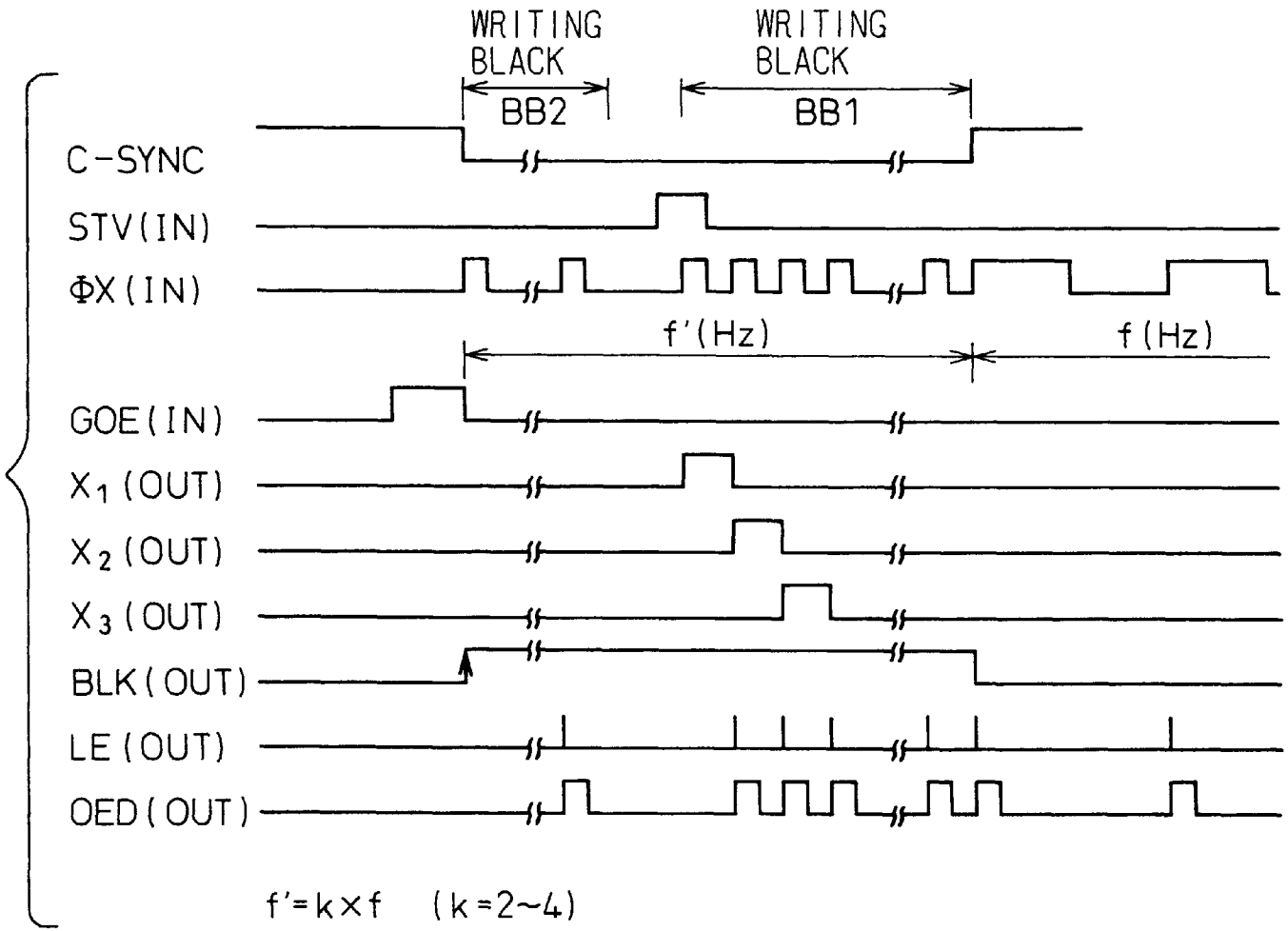
FIG. 12 is a timing chart showing a method of controlling the LCD of FIG. 4, according to a first embodiment of the first aspect of the present invention.

FIG. 12 is a timing chart showing a method of driving the LCD of FIG. 4, according to a first embodiment of the first aspect of the present invention.

The first embodiment writes black to the non-image areas BB1 and BB2 (FIG. 3) of the panel 1 during a vertical blanking period in which the composite signal C-SYNC is at low level. If the frequency of the gate shifting clock signal $\phi X$ is unchanged at f Hz, black will not completely be displayed in the areas BB1 and BB2 during the vertical blanking period. To solve this problem, the present invention multiplies the frequency f Hz by k into f' Hz ($f'=f\times k$). The constant k is, for example, 2 to 4. Black is written to the areas BB1 and BB2 at the frequency f' during the vertical blanking period. Data to be written to the areas BB1 and BB2 is not limited to black. It may be blue, or any other data.

Figure 13:
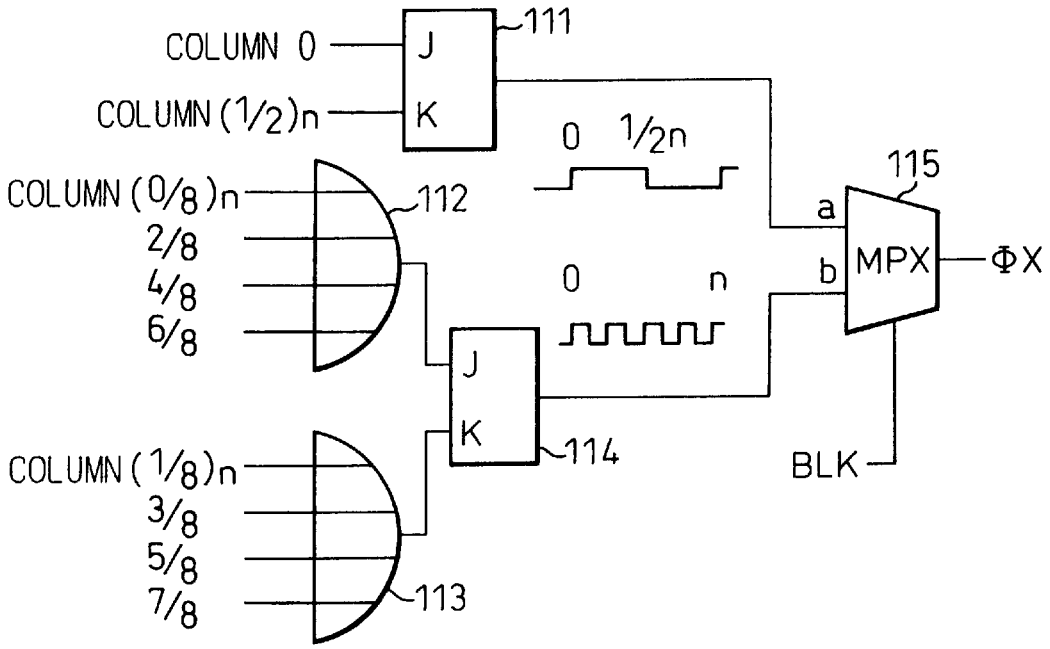
FIG. 13 shows a circuit for generating a gate shifting clock signal of FIG. 12.

FIG. 13 shows a circuit for generating the gate shifting clock signal ϕX of FIG. 12.

The circuit has two J–K flip-flops 111 and 114, two 4-input OR gates 112 and 113, and a multiplexer 115. A J terminal of the flip-flop 111 receives a 0-column select signal, and a K terminal thereof receives an n/2-column select signal. Input terminals of the OR gate 112 receive 0/8-, 2/8-, 4/8-, and 6/8-column select signals. Input terminals of the OR gate 113 receive 1/8-, 3/8-, 5/8-, and 7/8-column select signals. A J terminal of the flip-flop 114 receives the output of the OR gate 112, and a K terminal thereof receives the output of the OR gate 113.

The multiplexer 115 receives the outputs a and b of the flip-flops 111 and 114 and selects one of them according to the black control signal BLK. If the signal BLK is at high level, the multiplexer 115 selects the output b of the flip-flop 114 corresponding to the frequency f', and if it is at low level, the output a of the flip-flop 111 corresponding to the normal frequency f. Then, the multiplexer 115 provides the clock signal ϕX having the selected frequency.

Figure 14:
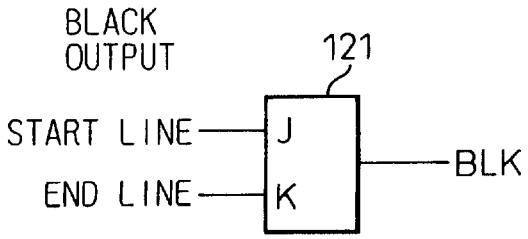
FIG. 14 shows a circuit for generating a black control signal of FIG. 12.

FIG. 14 shows a circuit for generating the black control signal BLK of FIG. 12.

The circuit consists of a J–K flip-flop 121 whose J terminal receives a select signal indicating a gate line to start displaying black and whose K terminal receives a select signal indicating a gate line to end displaying black. The flip-flop 121 increases the level of the signal BLK to high when the line counter 550 (FIG. 7) indicates a start gate line of any one of the non-image areas BB1 and BB2.

Figure 15:
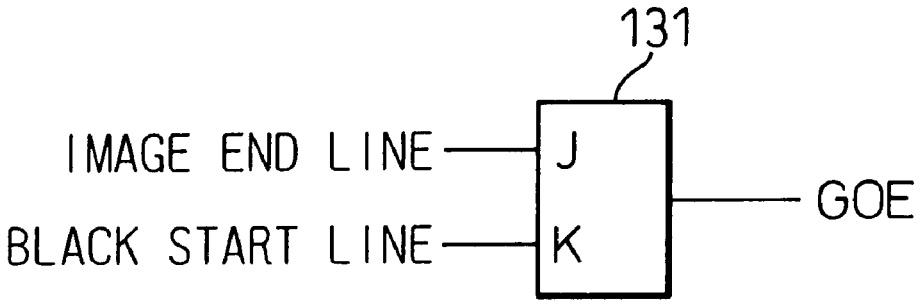
FIG. 15 shows a circuit for generating a gate output enable signal of FIG. 12.

FIG. 15 shows a circuit for generating the gate output enable signal GOE of FIG. 12.

The circuit consists of a J–K flip-flop 131 whose J terminal receives a select signal indicating a last gate line to display an image and whose K terminal receives a select signal indicating a black start line.

Figure 16:
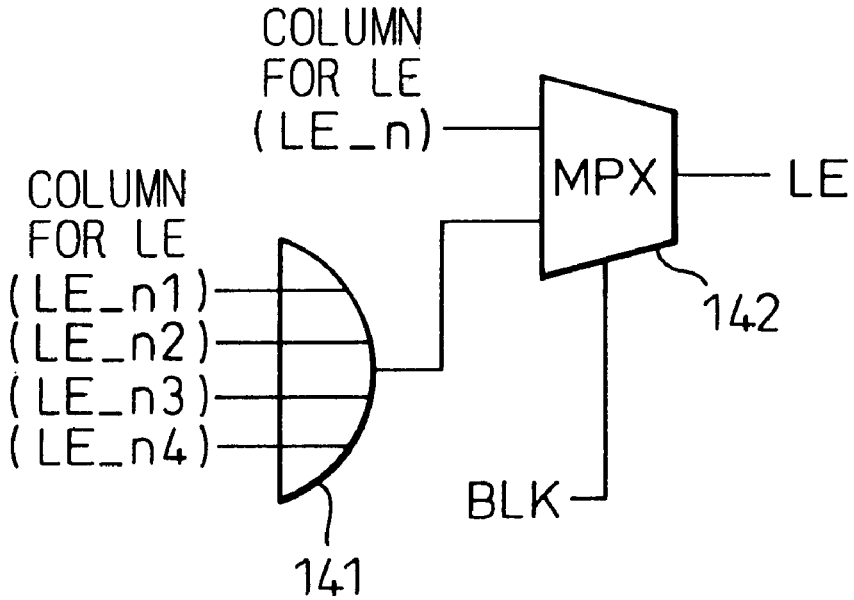
FIG. 16 shows a circuit for generating a latch enable signal of FIG. 12.

FIG. 16 shows a circuit for generating the latch enable signal LE of FIG. 12.

The circuit consists of a 4-input OR gate 141 and a multiplexer 142. The multiplexer 142 receives a signal LE-n generated for every gate line as well as the output (LE-n1, LE-n2, LE-n3, LE-n4) of the OR gate 141 generated four times per gate line. When the black control signal BLK is at high level, the multiplexer 142 selects the output of the OR gate 141, and when it is at low level, the signal LE-n. The selected signal is provided as the latch enable signal LE in synchronization with the clock signal ϕX.

Figure 17A:
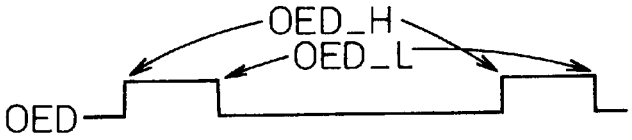
FIGS. 17A to 17C show a circuit for generating a data output enable signal of FIG. 12.
Figure 17B:
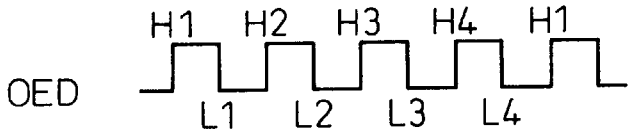
Figure 17C:
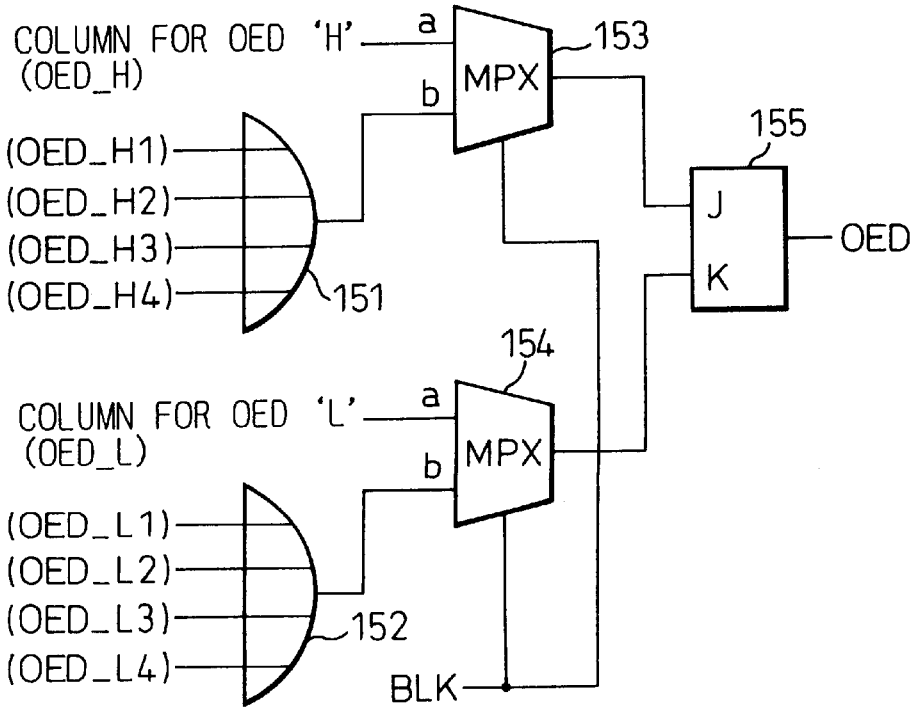

FIGS. 17A to 17C show a circuit for generating the data output enable signal OED of FIG. 12.

The circuit consists of two 4-input OR gates 151 and 152, two multiplexers 153 and 154, an a J–K flip-flop 155. The multiplexer 153 receives a timing signal OED-H that sets the signal OED to high level, as well as the output of the OR gate 151. The multiplexer 154 receives a timing signal OED-L that sets the signal OED to low level, as well as the output of the OR gate 152. Each of the multiplexers selects one of the inputs according to the black control signal BLK.

When the black control signal BLK is at high level, the multiplexers 153 and 154 select the outputs (logical sum of OED-H1 to OED-H4 and logical sum of OED-L1 to OED-L4) of the OR gates 151 and 152, respectively. When the signal BLK is at low level, they select the signals OED-H and OED-L. The output of the multiplexer 153 is supplied to a J terminal of the flip-flop 155, and the output of the multiplexer 154 is supplied to a K terminal of the same. The flip-flop 155 provides the data output enable signal OED.

The signal OED of FIG. 17A is provided when the black control signal BLK is at low level to select the input "a" of each multiplexer. The signal OED of FIG. 17B is provided when the signal BLK is at high level to select the input "b" of each multiplexer.

Figure 18:
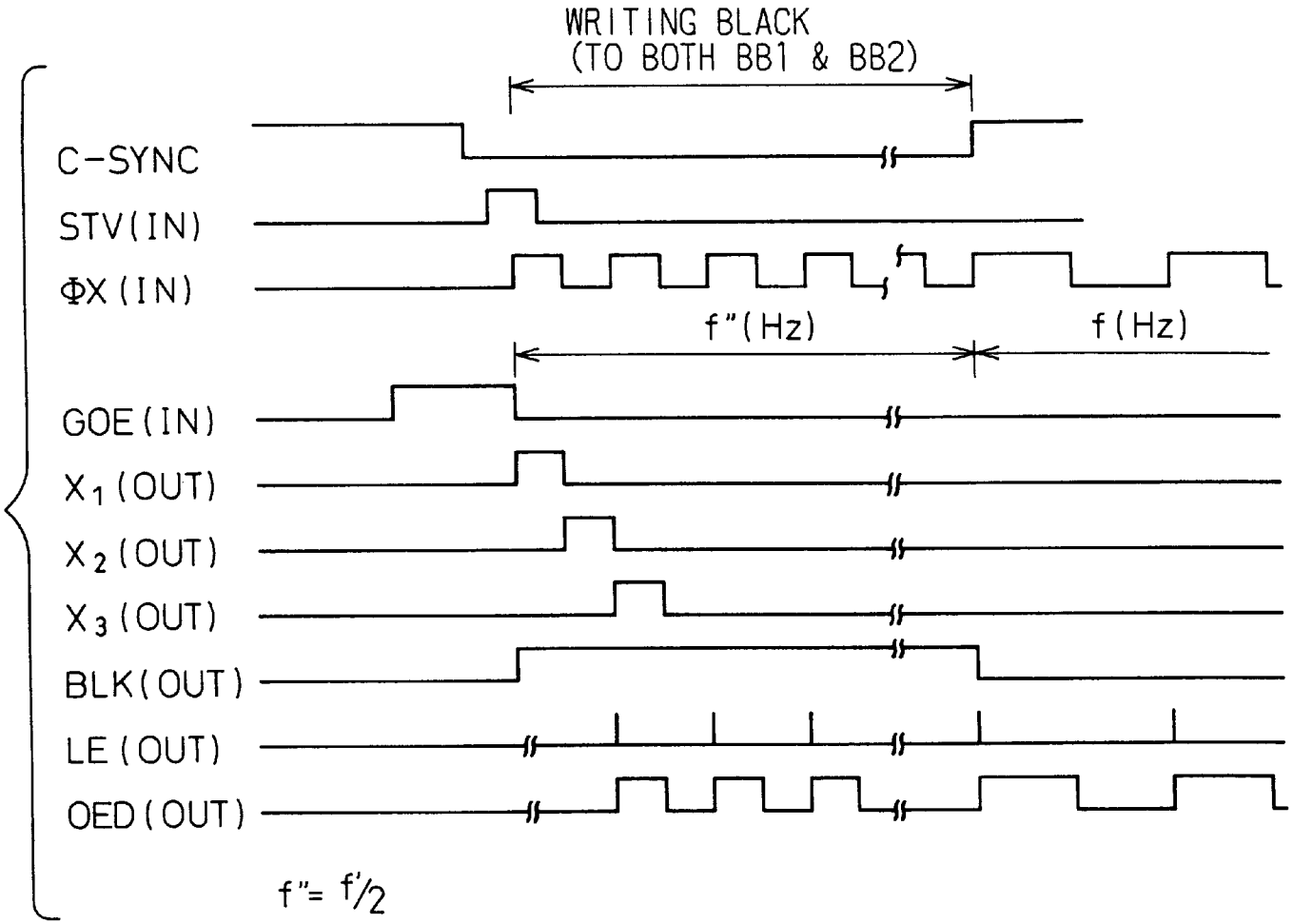
FIG. 18 is a timing chart showing a method of controlling the LCD of FIG. 4, according to a second embodiment of the first aspect of the present invention.

FIG. 18 is a timing chart showing a method of controlling the LCD of FIG. 4, according to a second embodiment of the first aspect of the present invention.

This embodiment writes black simultaneously to the non-image areas BB1 and BB2 of FIG. 3 during a vertical blanking period in which the composite signal C-SYNC is at low level. The frequency f" Hz of the gate shifting clock signal ϕX of the second embodiment is half the frequency f' Hz of that of the first embodiment of FIG. 12 (f"=f'/2). This results in simplifying the control of the LCD and reducing power consumption. The number of signals used by the second embodiment is smaller than that of the first embodiment, to simplify the structure of the timing controller 5.

Figure 19:
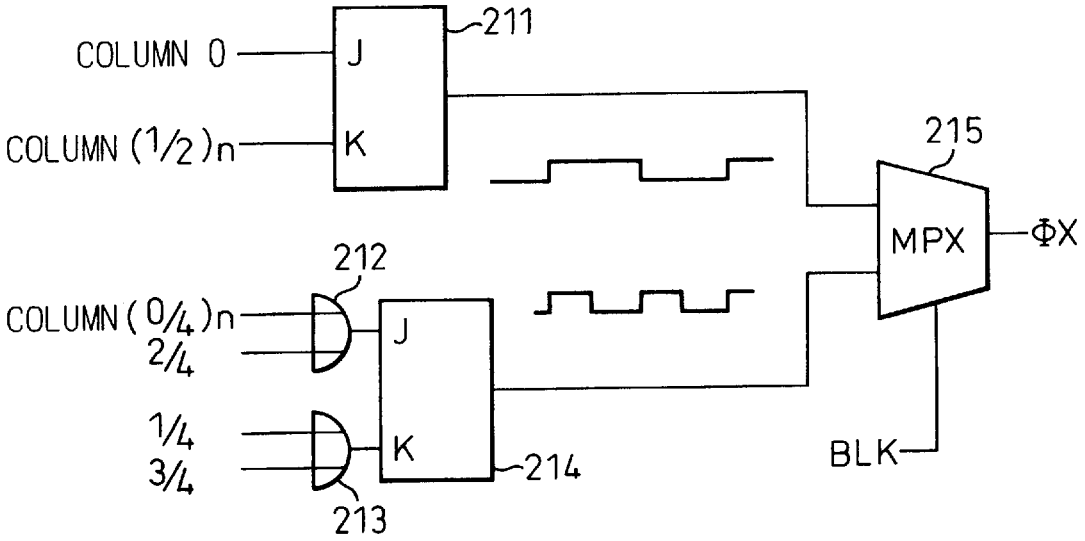
FIG. 19 shows a circuit for generating a gate shifting clock signal of FIG. 18.

FIG. 19 shows a circuit for generating the gate shifting clock signal ϕX of FIG. 18.

The circuit consists of two J–K flip-flops 211 and 214, two 2-input OR gates 212 and 213, and a multiplexer 215. A J terminal of the flip-flop 211 receives a 0-column select signal, and a K terminal thereof receives an n/2-column select signal. The OR gate 212 receives 0/4- and 2/4-column select signals. The OR gate 213 receives 1/4- and 3/4-column select signals. A J terminal of the flip-flop 214 receives the output of the OR gate 212, and a K terminal thereof receives the output of the OR gate 213. The number of signals the OR gates 212 and 213 receive is half the number of signals the OR gates 112 and 113 of FIG. 13 receive.

The outputs of the flip-flops 211 and 214 are supplied to the multiplexer 215, which selects one of them according to the black control signal BLK. If the signal BLK is at high level, the multiplexer 215 selects the frequency f" from the flip-flop 214, and if it is at low level, the frequency f from the flip-flop 211. The selected one determines the frequency of the clock signal ϕX. The frequency f" of the clock signal ϕX is half the frequency f' of the clock signal ϕX of FIG. 13.

Figure 20:
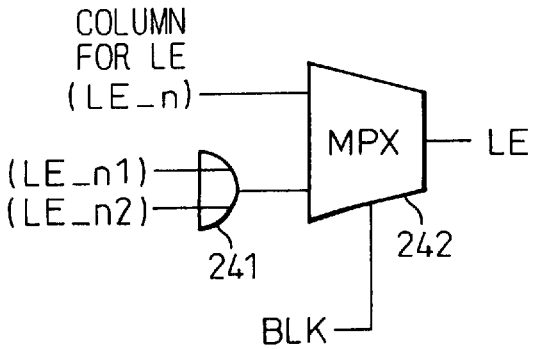
FIG. 20 shows a circuit for generating a latch enable signal of FIG. 18.

FIG. 20 shows a circuit for generating the latch enable signal LE of FIG. 18.

The circuit consists of a 2-input OR gate 241 and a multiplexer 242. The multiplexer 242 receives a signal LE-n generated for each gate line and the output (LE-n1, LE-n2) of the OR gate 241 that is provided twice per gate line. The multiplexer 242 selects one of them according to the black control signal BLK. The number of signals the OR gate 241 receives is half the number of signals the OR gate 141 of FIG. 16 receives. If the signal BLK is at high level, the multiplexer 242 selects the output of the OR gate 241, and if it is at low level, the signal LE-n. The selected signal is provided as the latch enable signal LE in synchronization with the clock signal ϕX of frequency f".

Figure 21A:
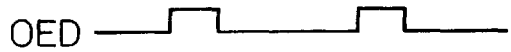
FIGS. 21A to 21C show a circuit for generating a data output enable signal of FIG. 18.
Figure 21B:
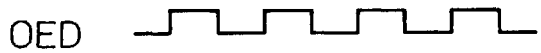
Figure 21C:
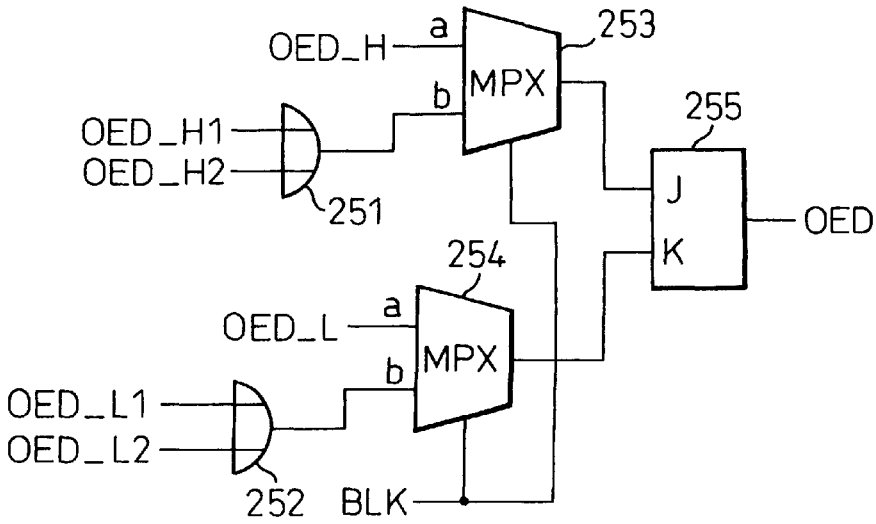

FIGS. 21A to 21C show a circuit for generating the data output enable signal OED of FIG. 18.

The circuit consists of two 2-input OR gates 251 and 252, two multiplexers 253 and 254, and a J–K flip-flop 255. This circuit differs from that of FIG. 17C in that the OR gate 251 receives signals OED-H1 and OED-H2 and the OR gate 252 receives signals OED-L1 and OED-L2. This circuit provides the data output enable signal OED in synchronization with the clock signal ϕX of frequency f".

The signal OED of FIG. 21A is provided when the black control signal BLK is at low level to select an input "a" of each multiplexer. The signal OED of FIG. 21B is provided when the signal BLK is at high level to select an input "b" of each multiplexer.

The black control signal BLK and gate output enable signal GOE of FIG. 18 may be generated by, for example, the circuits of FIGS. 14 and 15.

Figure 22:
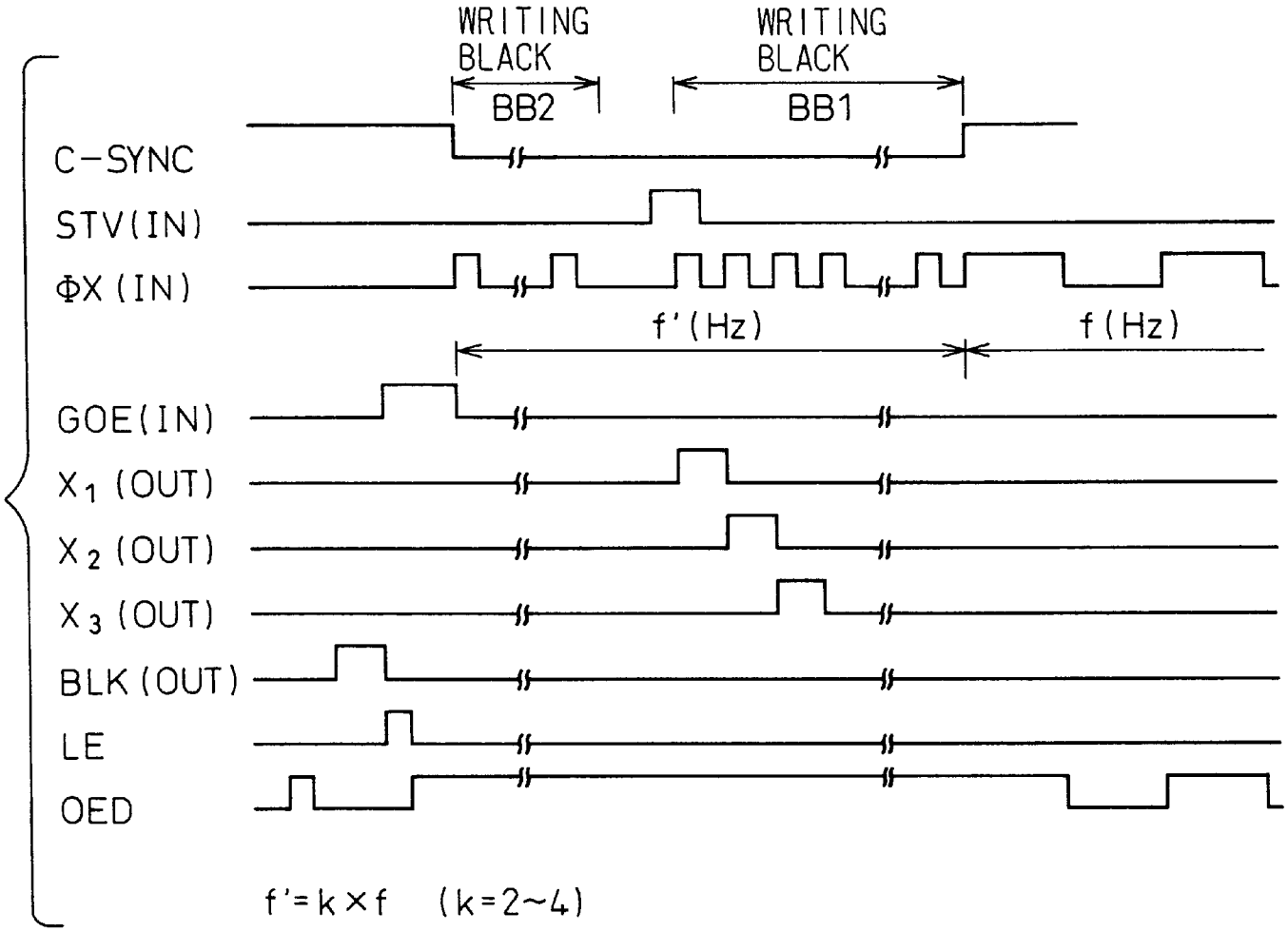
FIG. 22 is a timing chart showing a method of controlling the LCD of FIG. 4, according to a third embodiment of the first aspect of the present invention.

FIG. 22 is a timing chart showing a method of controlling the LCD of FIG. 4, according to a third embodiment of the first aspect of the present invention.

During a vertical blanking period in which the composite signal C-SYNC is at low level, the first embodiment of FIG. 12 raises the black control signal BLK to high level and generates the latch enable signal LE and data output enable signal OED in synchronization with the clock signal ϕX.

On the other hand, the third embodiment of FIG. 22 temporarily increases the data output enable signal OED to high level just before a vertical blanking period. Thereafter, the signal OED is kept at high level during the vertical blanking period. The third embodiment once increases the black control signal BLK and latch enable signal LE to high level just before the vertical blanking period. During the vertical blanking period, the signals BLK and LE are kept at low level. Although the first and third embodiments write black to the areas BB1 and BB2 of FIG. 3 separately, the third embodiment stores black data in the data driver 2 only once by once raising the signals OED, BLK, and LE just before a vertical blanking period, to thereby reduce power consumption.

Figure 23:
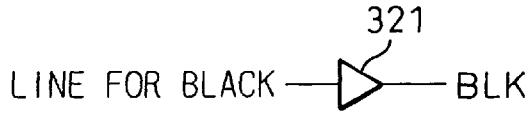
FIG. 23 shows a circuit for generating a black control signal of FIG. 22.

FIG. 23 shows a circuit for generating the black control signal BLK of FIG. 22. The circuit consists of a buffer 321 for amplifying a signal for selecting a gate line to which black is written.

Figure 24:
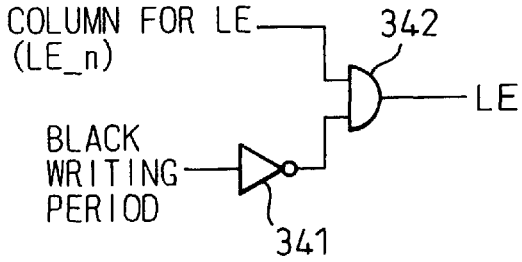
FIG. 24 shows a circuit for generating a latch enable signal of FIG. 22.

FIG. 24 shows a circuit for generating the latch enable signal LE of FIG. 22.

The circuit consists of an inverter 341 and an AND gate 342. An input terminal of the AND gate 342 receives a signal LE-n generated per gate line, and the other input thereof receives a signal indicating a black writing period through the inverter 341. The output of the AND gate 342 is the latch enable signal LE.

Figure 25:
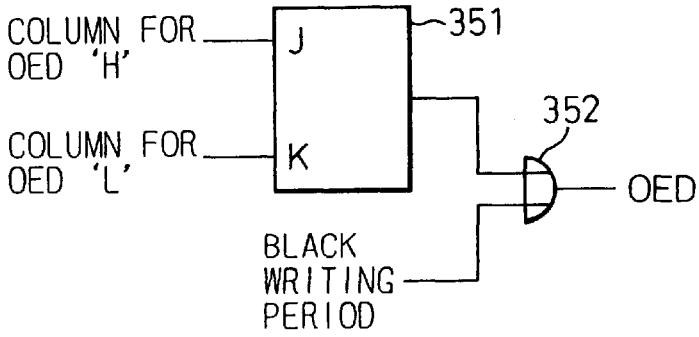
FIG. 25 shows a circuit for generating a data output enable signal of FIG. 22.

FIG. 25 shows a circuit for generating the data output enable signal OED of FIG. 22.

The circuit consists of a J–K flip-flop 351 and an OR gate 352. An input terminal of the OR gate 352 receives the output of the flip-flop 351, and the other input terminal thereof receives a signal indicating a black writing period. The output of the OR gate 352 is the data output enable signal OED. A J terminal of the flip-flop 351 receives a timing signal OED-H that sets the signal OED to high level, and a K terminal thereof receives a timing signal OED-L that sets the signal OED to low level.

These circuits provide the black control signal BLK, latch enable signal LE, and data output enable signal OED of FIG. 22.

Figure 26:
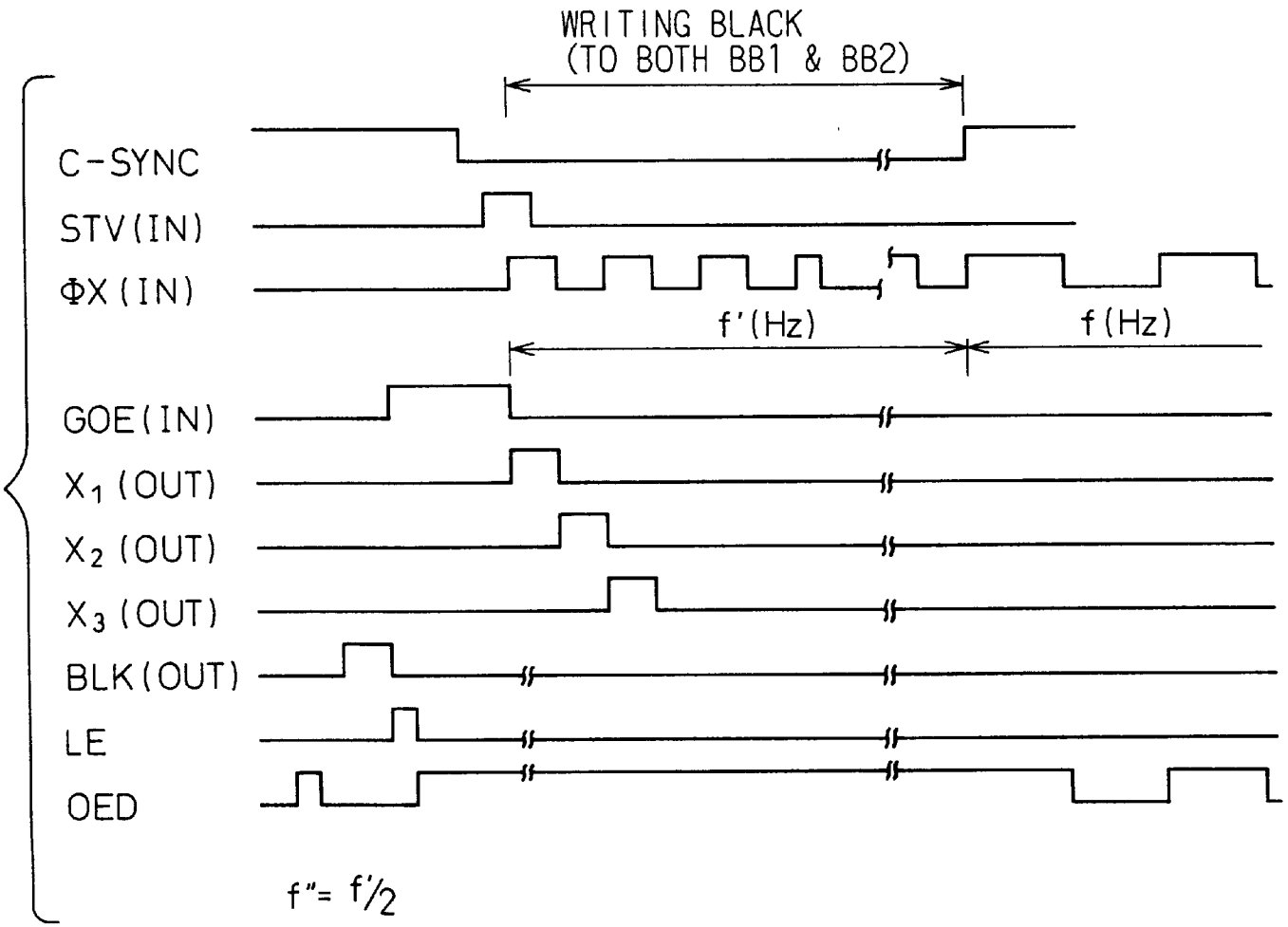
FIG. 26 is a timing chart showing a method of controlling the LCD of FIG. 4, according to a fourth embodiment of the first aspect of the present invention.

FIG. 26 is a timing chart showing a method of controlling the LCD of FIG. 4, according to a fourth embodiment of the first aspect of the present invention. This embodiment is a mixture of the second and third embodiments.

Control signals such as a gate shifting clock signal ϕX are combinations of the second and third embodiments.

Figure 27:
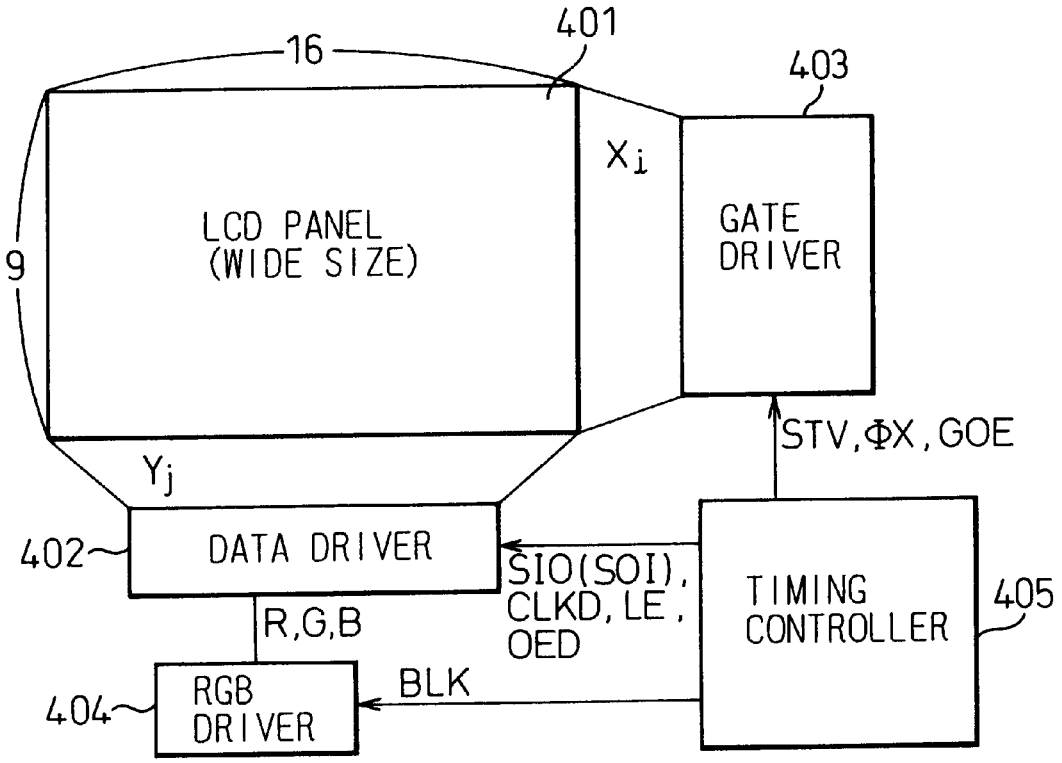
FIG. 27 is a block diagram showing an LCD according to an embodiment of a second aspect of the present invention.

FIG. 27 is a block diagram showing an LCD according to an embodiment of the second aspect of the present invention. The LCD has an LCD panel 401, a data driver 402, a gate driver 403, an RGB driver 404, and a timing controller 405.

On the contrary to the first aspect, the second aspect of FIGS. 27 to 36 displays a normal image without changing its aspect ratio on an LCD whose aspect ratio is designed for wide images.

The panel 401 has an aspect ratio of 9:16 for wide images. The data driver 402 stores display data for one gate line. The gate driver 403 sequentially selects gate lines of the panel 401, and data stored in the data driver 402 is written to the selected gate line.

The timing controller 405 provides the gate driver 403 with a vertical start signal STV, a gate shifting clock signal ϕX, and a gate output enable signal GOE. The timing controller 405 provides the data driver 402 with a data start signal SIO, a data shifting clock signal CLKD, a latch enable signal LE, and a data output enable signal OED. Further, the timing controller 405 provides the RGB driver 404 with a black control signal BLK. The RGB driver 4 provides the data driver 402 with red (R), green (G), and blue (B) display data. In practice, there are two data start signals SIO and SOI. When the signal SIO is at high level, data is supplied to each gate line in a right shift manner. When the signal SOI is at high level, data is supplied to each gate line in a left shift manner, to invert an image displayed. For the sake of simplicity, the following explanation refers only to the signal SIO.

Figure 28:
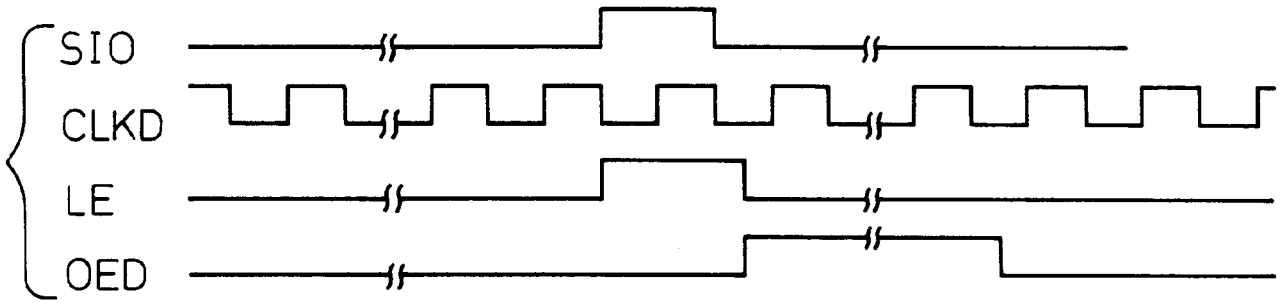
FIG. 28 is a timing chart showing the operation of a data driver of the LCD of FIG. 27.

FIG. 28 is a timing chart showing the operation of the data driver 402.

After the start signal SIO rises, the data driver 402 fetches data in response to the clock signal CLKD and supplies data for one gate line to the panel 401 in response to the latch enable signal LE and data output enable signal OED.

Figure 29:
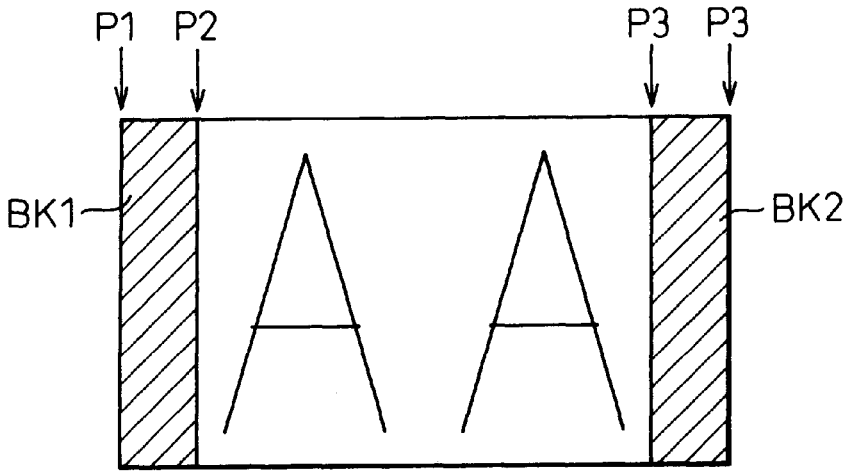
FIG. 29 shows an image displayed on the LCD of FIG. 27.

FIG. 29 shows the panel 401 displaying a normal image without changing the aspect ratio of the image. There are non-image areas BK1 and BK2 at the left and right edges of the panel 401. These areas display black.

Figure 30:
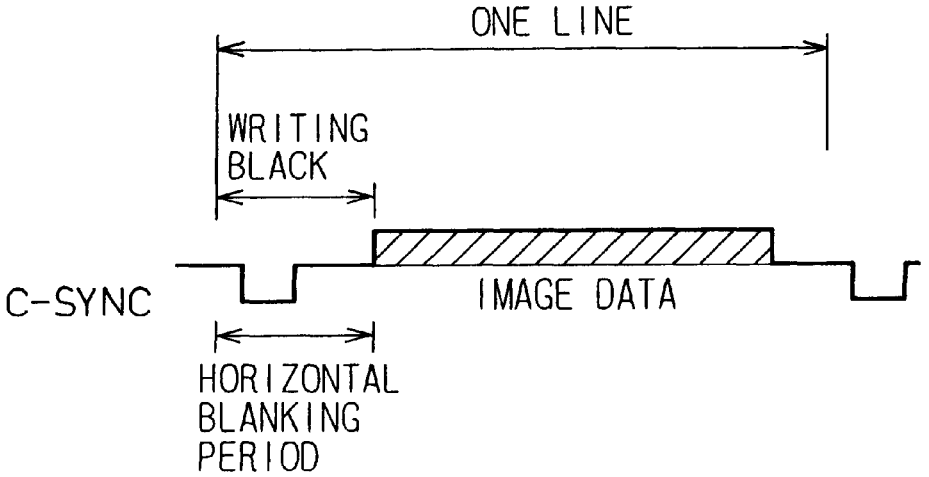
FIG. 30 shows a method of displaying an image according to the second aspect of the present invention.

FIG. 30 shows a method of displaying an image according to the second aspect of the present invention.

The second aspect writes black to the non-image areas BK1 and BK2 during the horizontal blanking period of each gate line, i.e., horizontal scan line. The frequency F' of the clock signal CLKD according to which black is written to the areas BK1 and BK2 during each horizontal blanking period is larger than the frequency F of the same signal during a usual display operation. This will be explained later.

Figure 31:
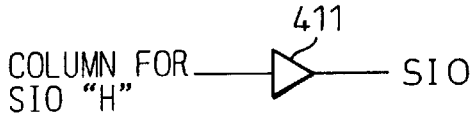
FIG. 31 shows a circuit for generating a horizontal start signal of FIG. 28.

FIG. 31 shows a circuit for generating the horizontal start signal SIO of FIG. 28. The circuit consists of a buffer 411 that amplifies a signal indicating a column to set the signal SIO to high level.

Figure 32:
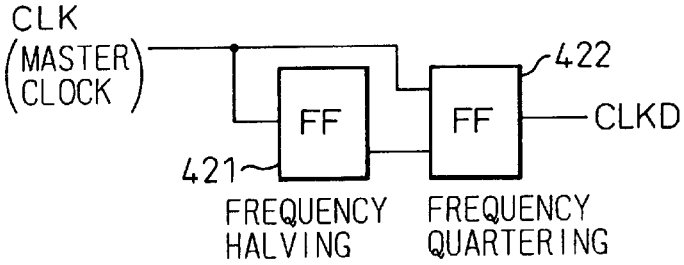
FIG. 32 shows a circuit for generating a data shift clock signal of FIG. 28.

FIG. 32 shows a circuit for generating the data shifting clock signal CLKD of FIG. 28. The circuit consists of two flip-flops 421 and 422 and quarters the frequency of a master clock signal CLK, to provide the signal CLKD. A divisor applied to the master clock signal CLK to provide the signal CLKD is not limited to four.

Figure 33:
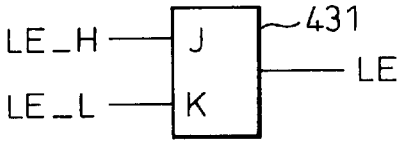
FIG. 33 shows a circuit for generating a latch enable signal of FIG. 28.

FIG. 33 shows a circuit for generating the latch enable signal LE of FIG. 28. The circuit consists of a J–K flip-flop 431. A J terminal of the flip-flop 431 receives a signal LE-H, and a K terminal thereof receives a signal LE-L. The output of the flip-flop 431 is the signal LE.

Figure 34:
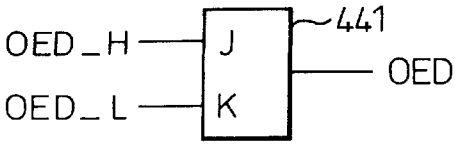
FIG. 34 shows a circuit for generating a data output enable signal of FIG. 28.

FIG. 34 shows a circuit for generating the data output enable signal OED of FIG. 28. The circuit consists of a J–K flip-flop 441. A J terminal of the flip-flop 441 receives a signal OED-H, and a K terminal thereof receives a signal OED-L. The output of the flip-flop 441 is the signal OED.

Figure 35:
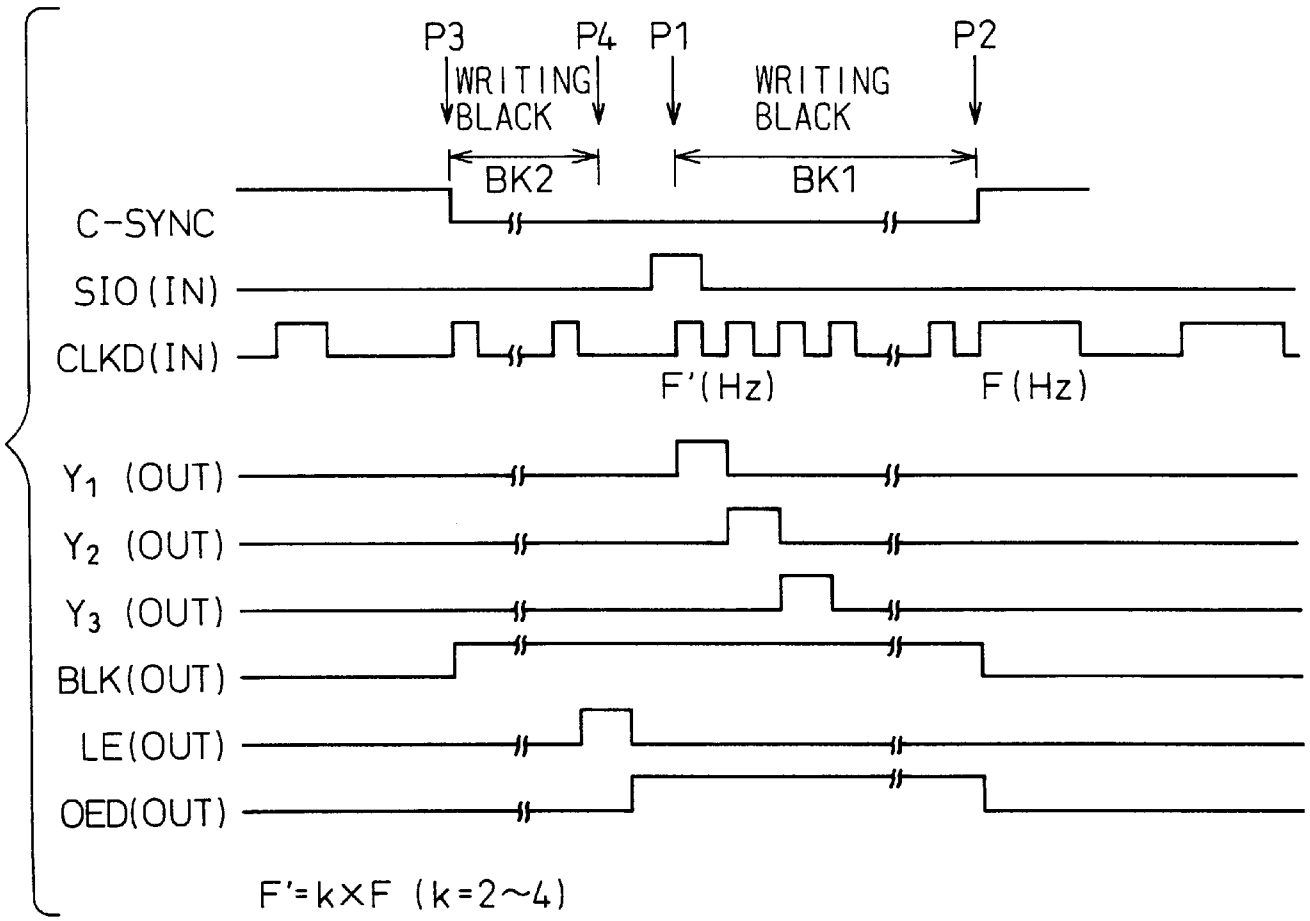
FIG. 35 is a timing chart showing a method of controlling the LCD of FIG. 27, according to an embodiment of the second aspect of the present invention.

FIG. 35 is a timing chart showing a method of controlling the LCD of FIG. 27, according to an embodiment of the second aspect of the present invention.

This embodiment writes black to the non-image areas BKl and BK2 of FIG. 29 during each horizontal blanking period in which the composite signal C-SYNC is at low level. If the frequency of the data shifting clock signal CLKD is equal to F Hz for normally writing data to the panel 401, black will not be written to the whole of the areas BKl and BK2 during the horizontal blanking period. To solve this problem, this embodiment multiplies the normal display frequency F Hz by k, to set the frequency F' Hz of the clock signal CLKD during the horizontal blanking period (F'=F×k). The constant k is in the range of 2 to 4 so that black is written to the areas BKl and BK2 completely during the horizontal blanking period. The data written to the areas BK1 and BK2 is not limited to black. It may be blue or any other data.

In FIGS. 29 and 35, black is written to the left non-image area BKl in the second half (P1 to P2, Y1, Y2, . . .) of the horizontal blanking period and to the right non-image area BK2 in the first half (P3 to P4) of the same period.

Figure 36:
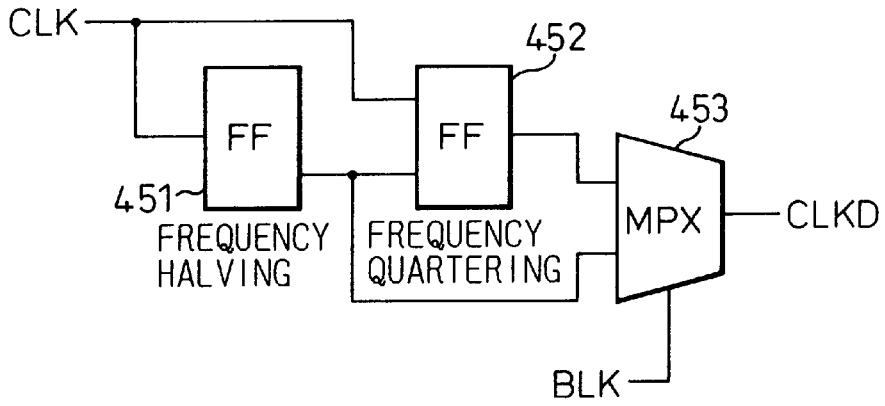
FIG. 36 shows a circuit for generating a data shifting clock signal of FIG. 35.

FIG. 36 shows a circuit for generating the data shifting clock signal CLKD of FIG. 35.

The circuit consists of two flip-flops 451 and 452 and a multiplexer 453. The flip-flop 451 halves the frequency of the master clock signal CLK and provides an input terminal of the multiplexer 453 with the frequency-halved signal. The flip-flops 451 and 452 quarter the frequency of the signal CLK, and the frequency-quartered signal is supplied to the other input terminal of the multiplexer 453. The multiplexer 453 selects one of the inputs according to the black control signal BLK.

When writing black during a horizontal blanking period, the quartered signal is selected to write black at high speed.

According to NTSC (National Television System Committee) standards, a horizontal scan period is 63.556 μsec. In this period, a period for displaying usual image data is 52.656 μs. Namely, a horizontal blanking period is 10.9 μsec within which black must be written to the areas BK1 and BK2. It is impossible to write black to the areas BK1 and BK2 completely within 10.9 μs. To solve this problem, the second aspect of the present invention shortens the period of a clock signal to write black. Shortening the period of the clock signal, i.e., increasing the frequency of the clock signal, however, involves severe timing, complicated circuit designing, and large power consumption. This problem will be solved by the third aspect of the present invention.

Figure 37:
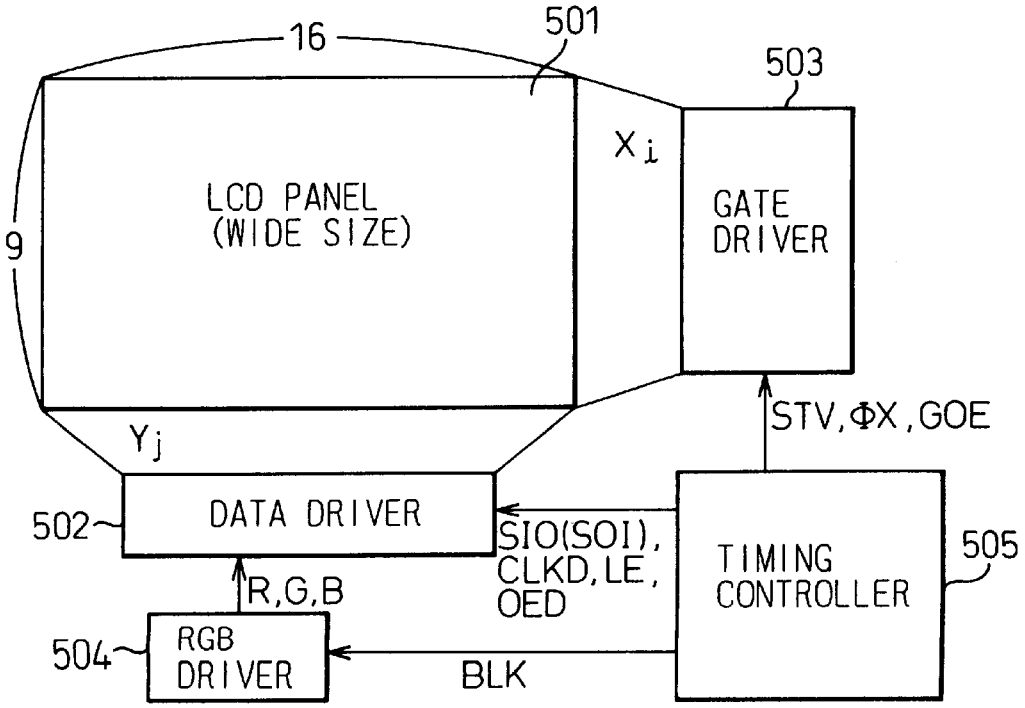
FIG. 37 is a block diagram showing an LCD according to a third aspect of the present invention.

FIG. 37 is a block diagram showing an LCD according to the third aspect of the present invention. The LCD has an LCD panel 501, a data driver 502, a gate driver 503, an RGB driver 504, and a timing controller 505.

Figure 38:
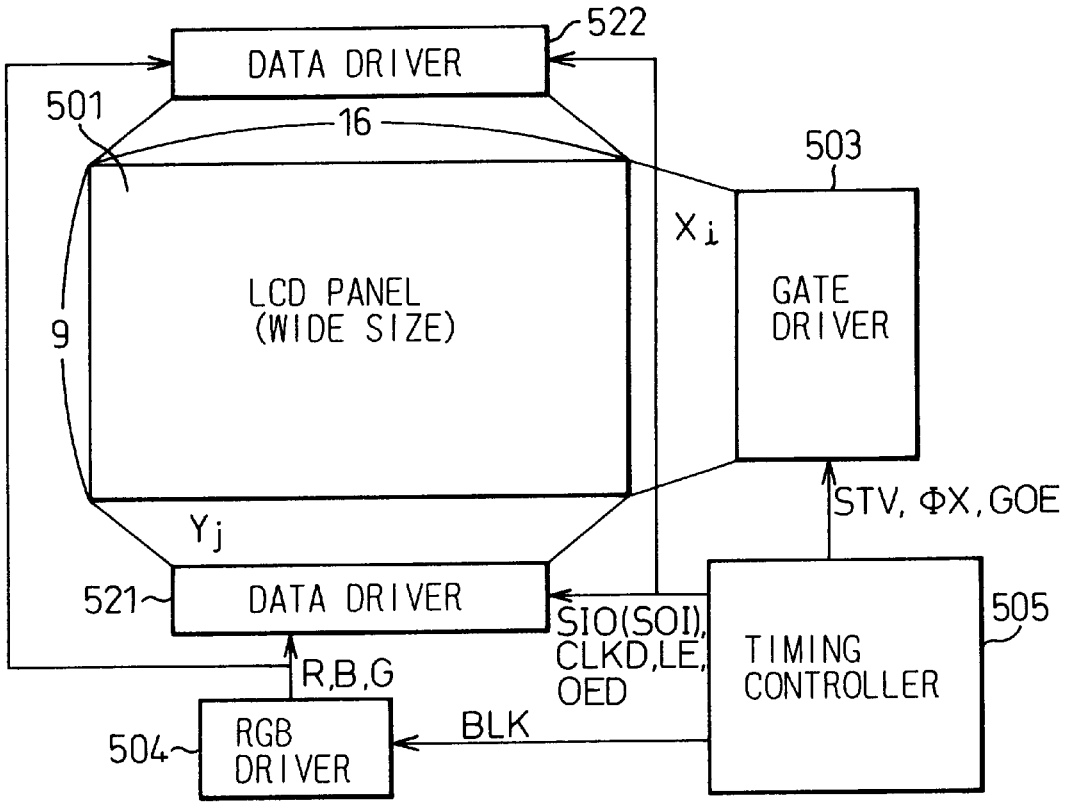
FIG. 38 is a block diagram showing another LCD according to the third aspect of the present invention.

FIG. 38 is a block diagram showing another LCD according to the third aspect of the present invention. This LCD differs from that of FIG. 37 in that it has data drivers 521 and 522 on each side of the LCD panel 501.

The panel 501 has an aspect ratio of 9:16 for wide images. When displaying a normal image of 3:4 in aspect ratio on the panel 501, the third aspect writes black simultaneously to the left and right non-image areas BK1 and BK2 (FIG. 29) on the panel 501 during a horizontal blanking period. As a result, the frequency F" of writing black of the third aspect is half the frequency F' of the second aspect.

To achieve this, the timing controller 505 changes the timing of control signals supplied to the data driver 502 (521, 522), so that the driver 502 (521, 522) may receive black simultaneously for the areas BK1 and BK2 at the normal frequency F.

Figure 39:
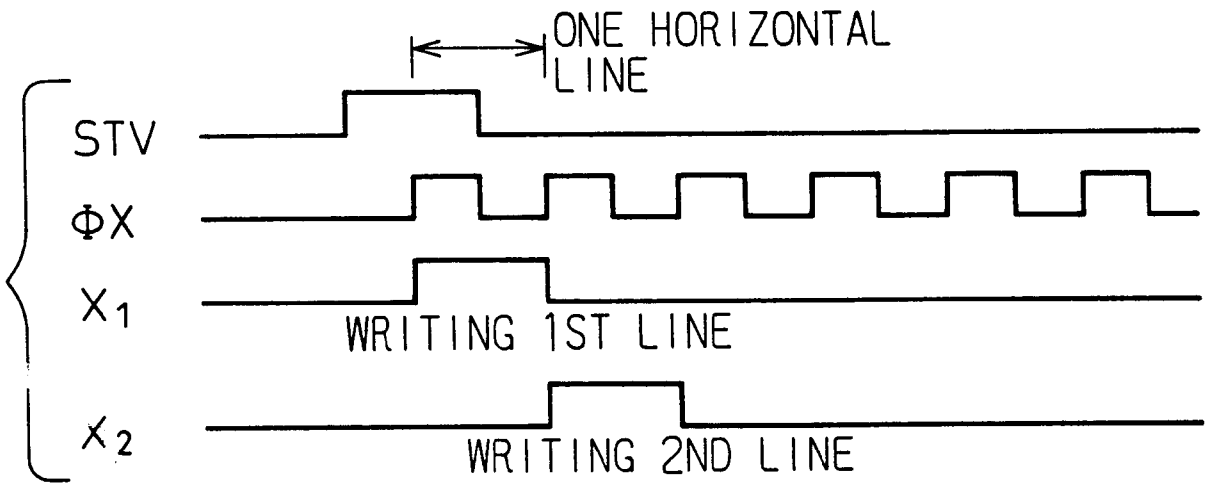
FIG. 39 is a timing chart showing the operation of a gate driver of the LCD of FIG. 37.
Figure 40:
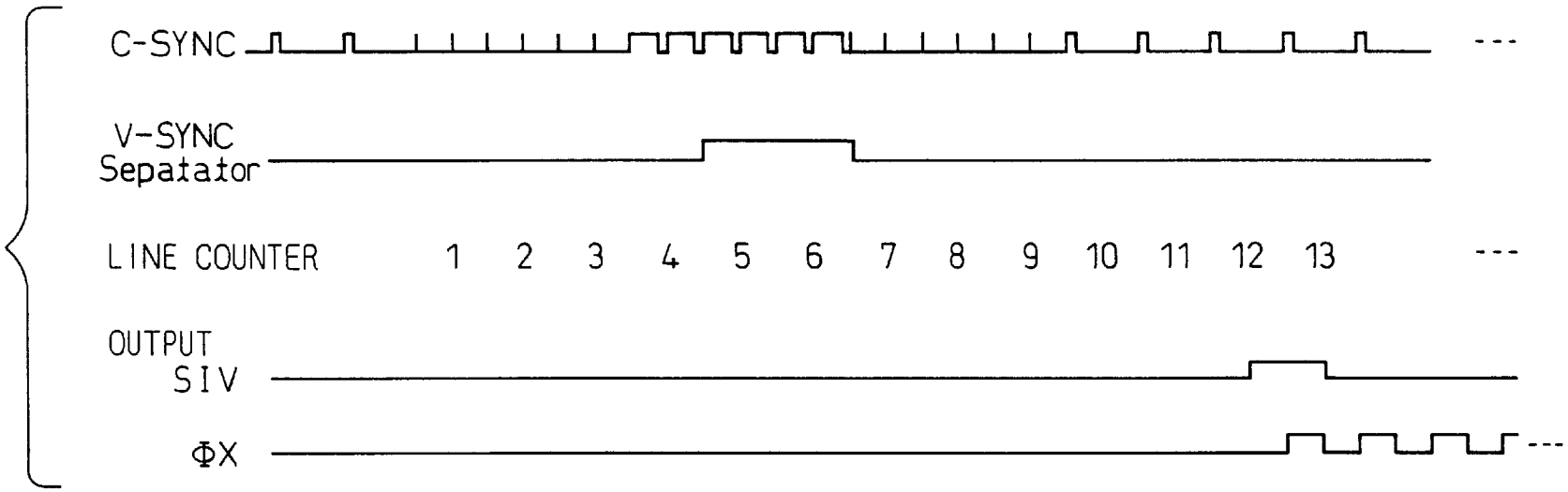
FIG. 40 is a timing chart showing the details of FIG. 39.

FIG. 39 is a timing chart showing the operation of the gate driver 503 of FIG. 37, and FIG. 40 shows the details of FIG. 39. The control timing of the gate driver 503 is unchanged between wide and normal images.

In FIG. 40, the output of a separator (54 in FIG. 7) changes in response to a composite signal C-SYNC. A line counter 550 arranged in a vertical timing pulse generator (55 in FIG. 7) sequentially counts gate lines on the panel 501. In response to a gate start signal STV provided by the vertical timing pulse generator, a gate shifting clock signal ϕX is provided. The operation of the gate driver 503 of FIGS. 39 and 40 is the same as that of the second aspect.

Figure 41:
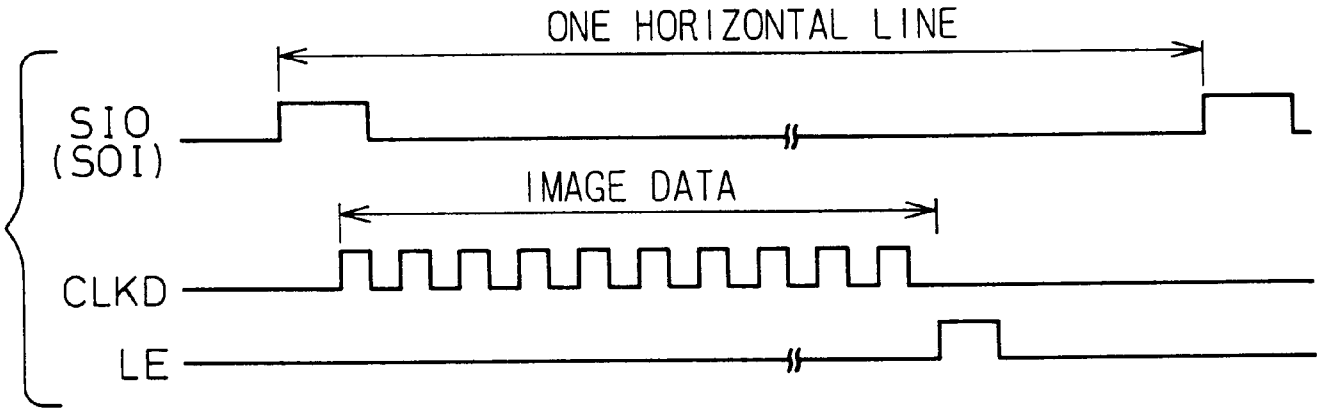
FIG. 41 is a timing chart showing the operation of a data driver of the LCD of FIG. 37.
Figure 42:
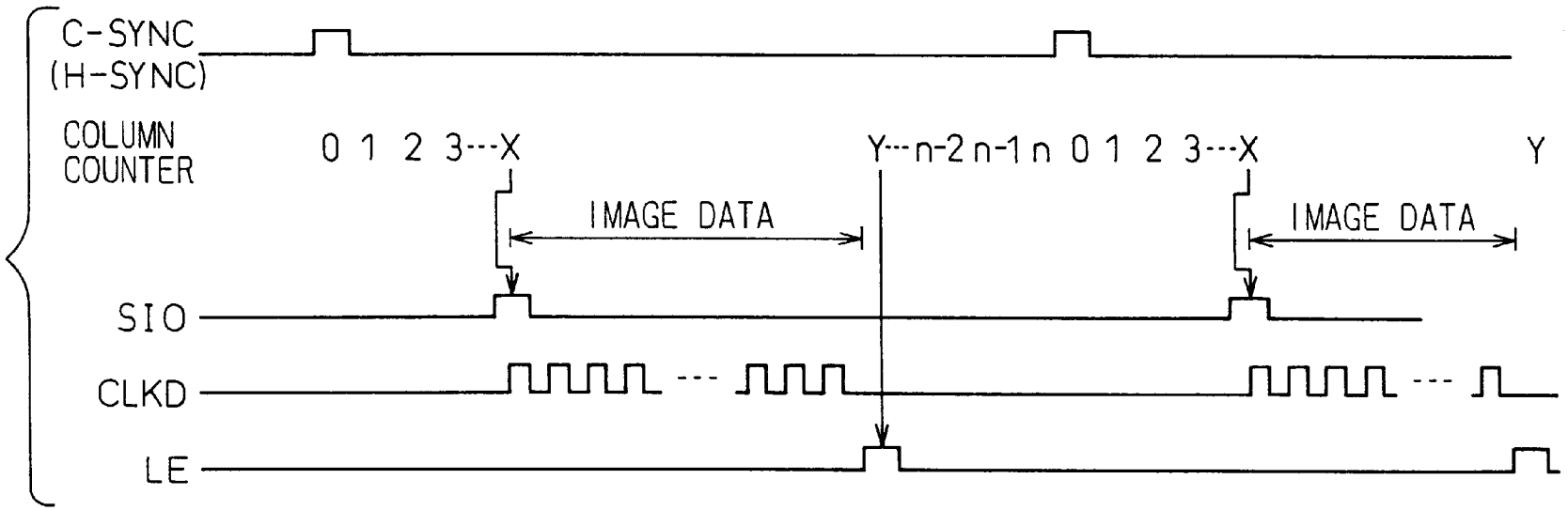
FIG. 42 is a timing chart showing the details of FIG. 41.

FIG. 41 is a timing chart showing the operation of the data driver 502 of FIG. 37, and FIG. 42 shows the details of FIG. 41, to display a wide image on the wide panel 501.

In FIG. 41, a data start signal SIO is provided, and the data driver 502 fetches data in response to a data shifting clock signal CLKD. In response to a latch enable signal LE, the data driver 502 supplies data for one gate line (horizontal scan line) to the panel 501. More precisely, the data driver 502 fetches the voltages of R, G, and B terminals at each fall of the clock signal CLKD and transfers data for one gate line to an internal output driver on the panel 501 side.

In FIG. 42, the composite signal C-SYNC (horizontal synchronizing signal H-SYNC) is provided, and a column counter 560 of a horizontal timing pulse generator (56 in FIG. 7) sequentially counts columns on the panel 501. When the data start signal SIO is provided by the horizontal timing pulse generator, the data driver 502 latches data for one gate line according to the clock signal CLKD. Thereafter, the latch enable signal LE is provided.

Figure 43:
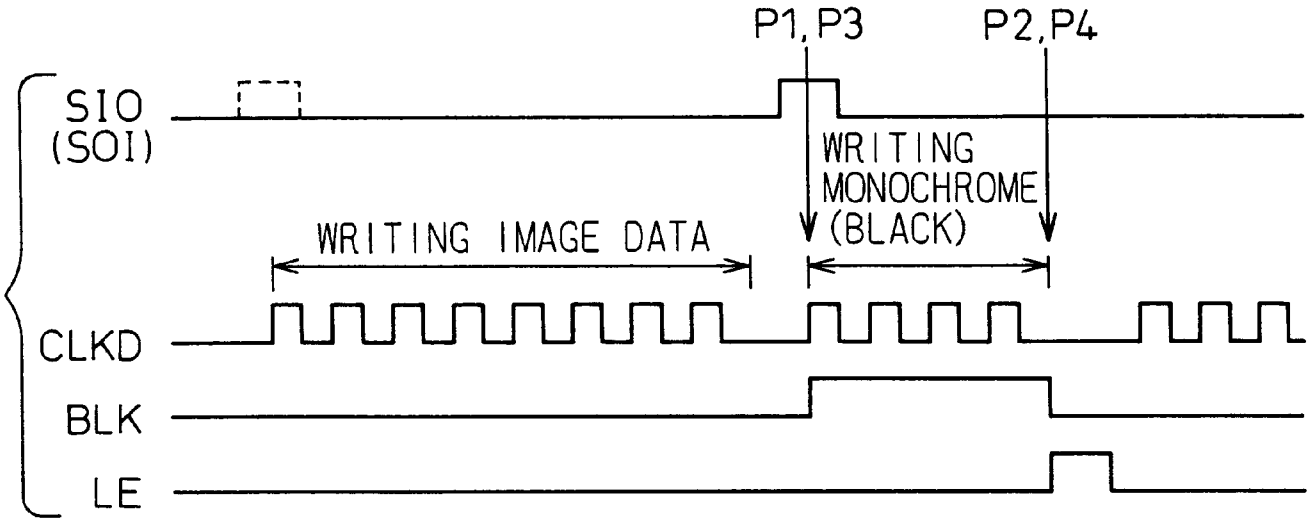
FIG. 43 is a timing chart showing the operation of the data driver of the LCD of FIG. 37, according to a first embodiment of the third aspect of the present invention.
Figure 44:
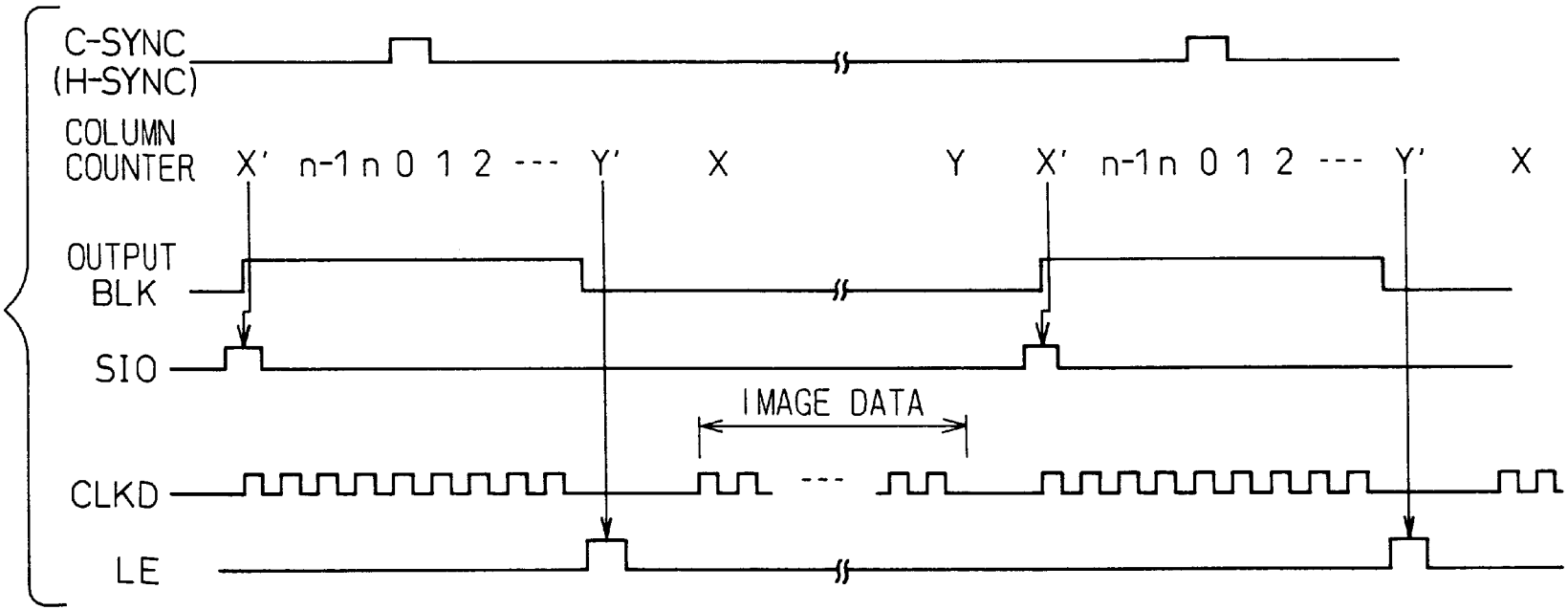
FIG. 44 is a timing chart showing the details of FIG. 43.

FIG. 43 is a timing chart showing the operation of the data driver 502 of FIG. 37, and FIG. 44 shows the details of FIG. 43, when displaying a normal image of 3:4 in aspect ratio on the wide panel 501 having an aspect ratio of 9:16.

In a horizontal blanking period in which the black control signal BLK is at high level, the RGB driver 504 provides the data driver 502 with a voltage corresponding to black. In response to, for example, a fall of the clock signal CLKD, black is written simultaneously to regions of the data driver 502 corresponding to the non-image areas BK1 and BK2. When data for one gate line, i.e., one horizontal scan line is ready in the data driver 502, the latch enable signal LE is provided.

In FIG. 44, the composite signal C-SYNC (horizontal synchronizing signal H-SYNC) is provided, and the column counter 560 of the horizontal timing pulse generator 56 sequentially counts columns on the panel 501. When usually displaying an image on the wide panel 501, the output timing of the data start signal SIO is changed from X to X' counted by the column counter 560, and the output timing of the latch enable signal LE from Y to Y' counted by the column counter 560. This is understood from comparison between FIGS. 42 and 44. During a horizontal blanking period in which the black control signal BLK is at high level, black is written simultaneously to the non-image areas BK1 and BK2.

Figure 45:
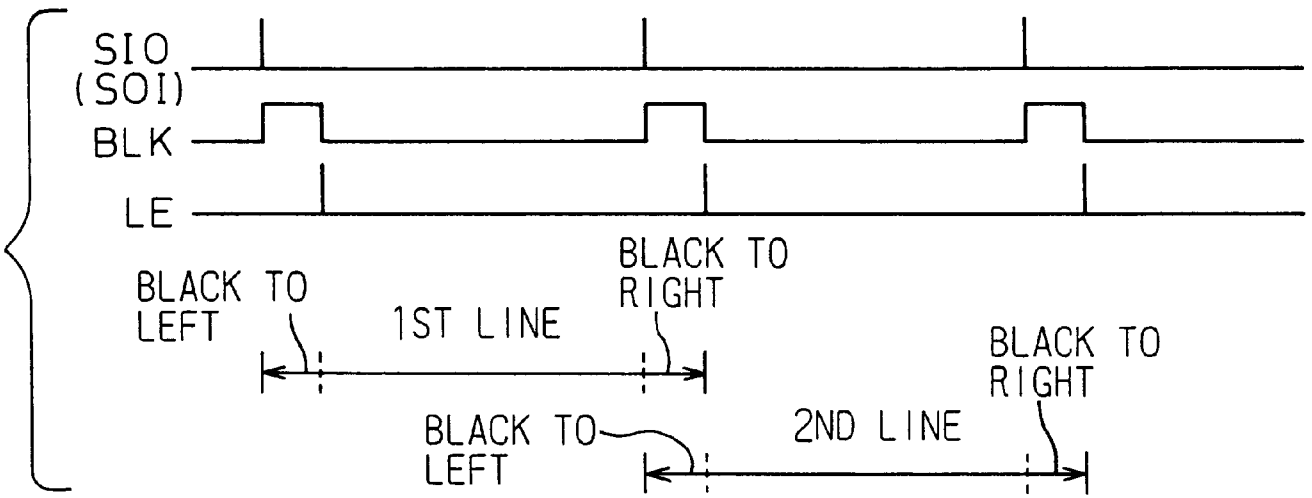
FIG. 45 is a timing chart showing the operation of the data driver of the LCD of FIG. 37, according to a second embodiment of the third aspect of the present invention.

FIG. 45 is a timing chart showing the operation of the data driver 502 of FIG. 37, according to a second embodiment of the third aspect of the present invention.

When displaying a normal image on the wide panel 501, black data for the non-image area BK2 of a given gate line and black data for the non-image area BK1 of the next gate line are simultaneously fetched.

This technique halves a time for fetching black for the areas BK1 and BK2 with the frequency of the clock signal CLKD being unchanged. The third aspect of the present invention is applicable to the LCD employing the two data start signals SIO and SOI. When the start signal SIO is at high level, data for each gate line is shifted from left to right. When the start signal SOI is at high level, data for each gate line is shifted from right to left, to invert an image displayed.

Although the above explanation relates to displaying normal and wide television images, the present invention is not limited to this. The present invention is applicable to adjusting a given image signal to a display screen (an LCD panel). The present invention is applicable not only to active-matrix LCDs but also to various kinds of displays such as plasma display panels (PDPs) that employ a matrix of pixels driven by gate and data drovers.

Generally, an LCD panel is designed for a specific image size. An LCD panel having 1024×768 dots is not intended to display an image of 640×480 dots.

To display an image of 640×480 dots on the 1024×768-dot panel, each dot of the panel may be related to each dot of the image, or several dots of the panel may be related to one dot of the image. To correctly display the image on the display, it is preferable to multiply each dot of the image by an integer. However, the ratio of 1024×768 to 640×480 is 5:3. If the image of 640×480 dots is doubled, it will be greater than the panel. If the image is displayed on the panel dot by dot, the panel will have many pixels without image data. In this case, some data must be written to these redundant pixels.

When displaying an image on an LCD panel whose size is larger than the image, it is necessary to write, during a blanking period, some data that may not spoil the view to pixels of the panel having no image data.

It takes 10 odd microseconds to several tens of microseconds to change the transmissivity of liquid crystals of an LCD panel to about 100%. This is too long compared with a blanking period. If the number of gate lines (horizontal scan lines) having no image data is large, there will be no time to drive all of such gate lines.

The fourth aspect of the present invention displays an image on an LCD panel whose size is larger than the image even if a blanking period is short or even if there are many gate lines having no image data. The fourth aspect writes data such as black, which does not spoil the view, to each pixel having no image data of each gate line of the panel.

Figure 46:
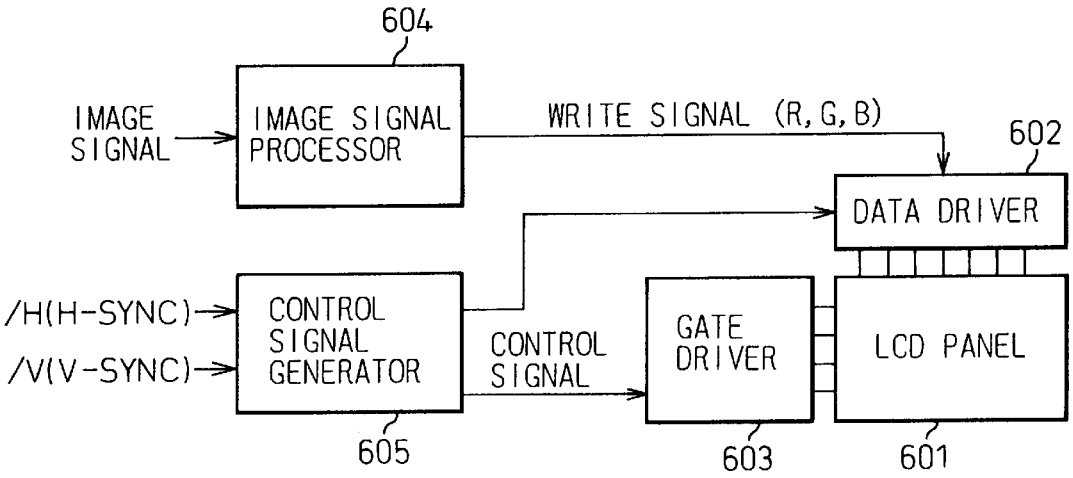
FIG. 46 is a block diagram showing an LCD according to a fourth aspect of the present invention.
Figure 47:
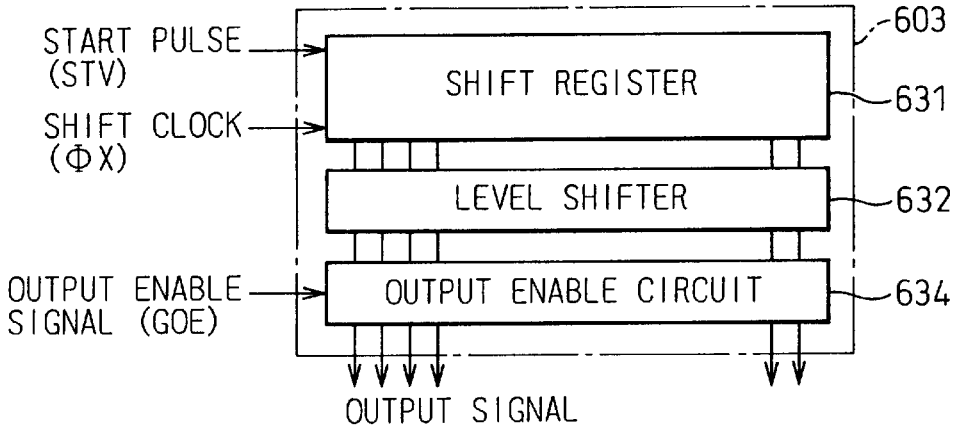
FIG. 47 is a block diagram showing a gate driver of the LCD of FIG. 46.
Figure 48:
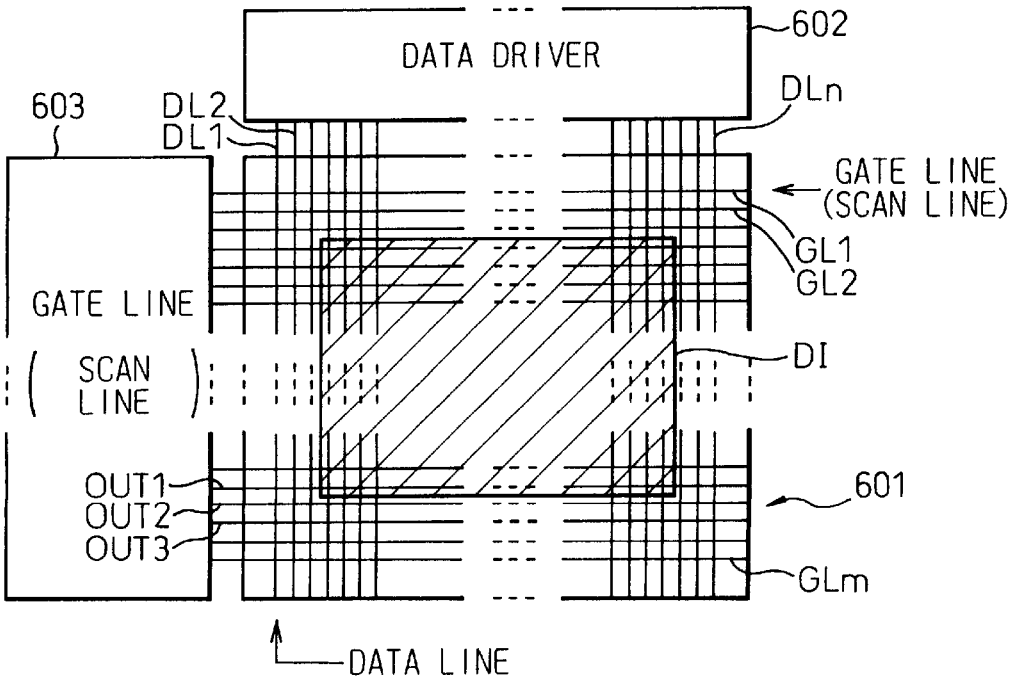
FIG. 48 shows connections between an LCD panel and drivers of the LCD of FIG. 46.

FIG. 46 is a block diagram showing an LCD according to the fourth aspect of the present invention, FIG. 47 is a block diagram showing a gate driver 603 of FIG. 46, and FIG. 48 shows connections between drivers and an LCD panel of FIG. 46.

In FIG. 46, the LCD has the LCD panel 601, data driver 602, gate driver (scan driver) 603, an image signal processor (RGB driver) 604, and a control signal generator (timing controller) 605.

A display source such as a computer provides synchronous signals/H (H-SYNC) and/V (V-SYNC) and image signals, which are converted by the control signal generator 605 and image signal processor 604 into signals for driving the panel 601 through the gate driver 603 and data driver 602.

In FIG. 47, the gate driver 603 consists of a shift register 631 for sequentially scanning the gate lines of the panel 601, a level shifter 632 for changing the levels of voltages provided by the shift register 631 into proper ones for driving the panel 601, and an output enable circuit 634 for controlling output signals.

In FIG. 48, the outputs of the data driver 602 are connected to data lines DL1 to DLn of the panel 601, and the outputs of the gate driver 603 are connected to the gate lines (scan lines) GL1 to GLm of the panel 601.

The panel 601 has, for example, a matrix of 1024×768 dots. An image DI to be displayed on the panel 601 consists of, for example, 640×480 dots. The fourth aspect of the present invention displays predetermined data (for example, black) in top, bottom, left, and right areas of the panel 601 where the image DI is not present. For this purpose, the second and third aspects of the present invention may be employed. Alternatively, another technique may be employed.

FIGS. 49 to 52 are timing charts showing the operation of the gate driver 603, according to a first embodiment of the fourth aspect of the present invention. The figures correspond to first to fourth frames, respectively.

Figure 49:
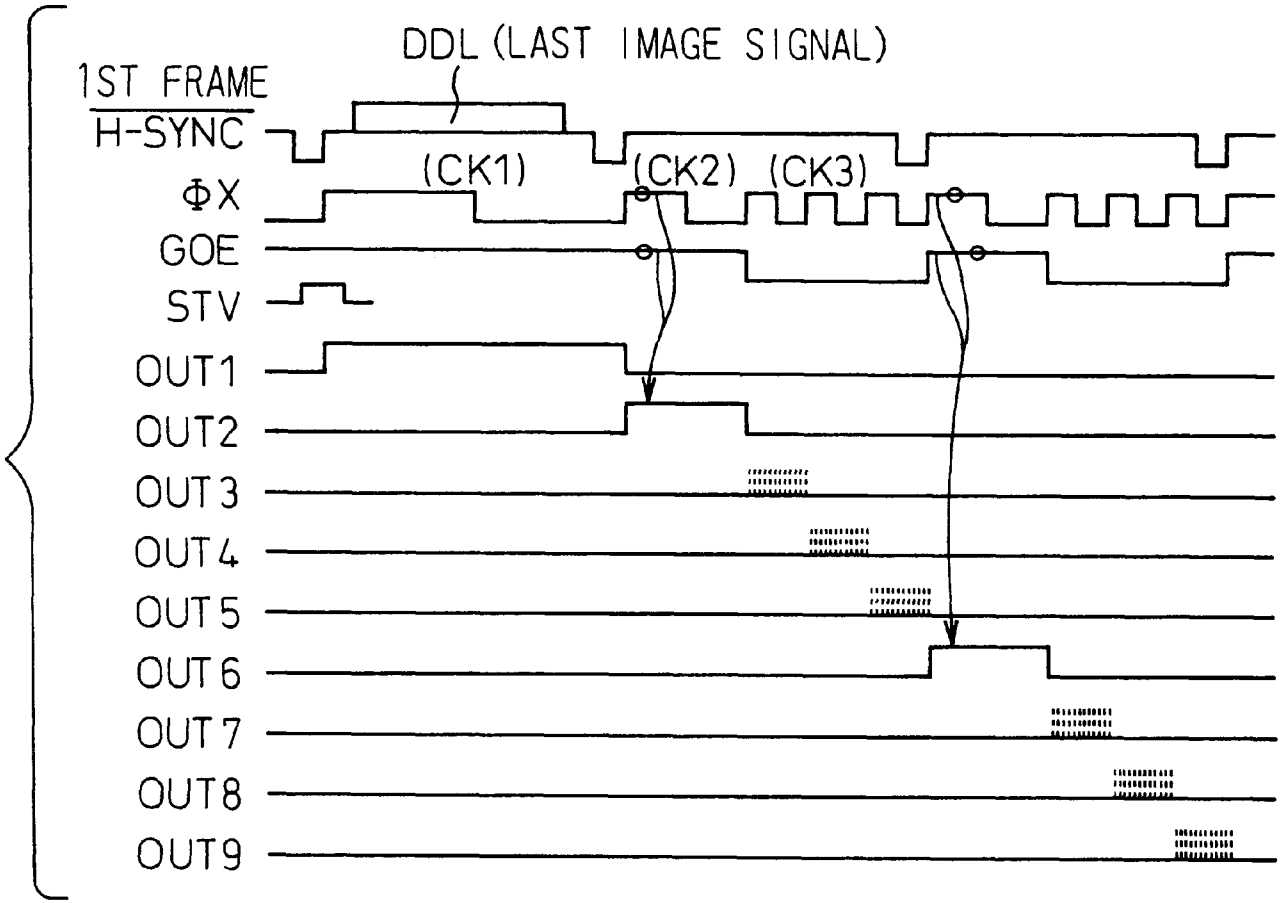
FIG. 49 is a timing chart (1) showing the operation of the gate driver of the LCD of FIG. 46, according to a first embodiment of the fourth aspect of the present invention.

In the first frame of FIG. 49, last display data DDL for the last line of the first frame of the image DI is written to a gate line (horizontal scan line) OUT1 according to a pulse CK1 of a gate shifting clock signal ϕX. Black is written to the next gate line OUT2, which is the first gate line in the bottom area of the panel 601 where the image DI is not present, in response to a pulse CK2 of the clock signal ϕX. Black is written to every fourth gate line (OUT6, OUT10, . . . ) in response to each pulse CK2 of the clock signal ϕX. Namely, the gate output enable signal GOE is set to high level in response to the pulses CK1 and CK2 of the clock signal ϕX, to write black to every fourth gate line (OUT2, OUT6, . . . ). The remaining gate lines (OUT3 to OUT5, OUT7 to OUT9, . . . ) are skipped in response to pulses CK3 whose period is shorter than that of the pulse CK2, with the signal GOE being set to low level.

Figure 50:
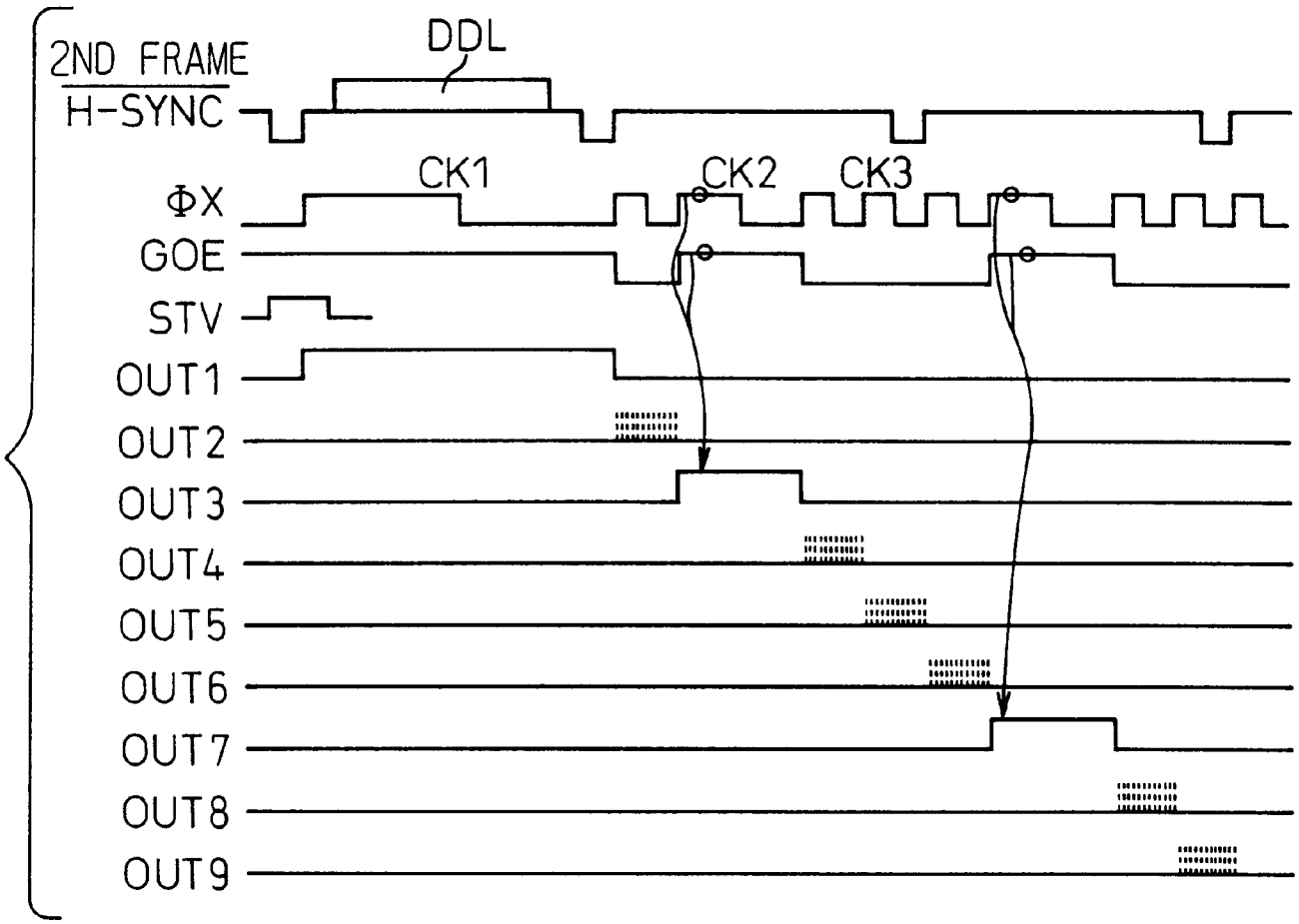
FIG. 50 is a timing chart (2) showing the operation of the same gate driver.

In the second frame of FIG. 50, last display data DDL for the last line of the second frame of the image DI is written to the gate line OUT1 according to a pulse CK1 of the clock signal ϕX. Black is written to the gate line OUT3, which is the second gate line in the bottom area of the panel 601 where the image DI is not present, in response to a pulse CK2 of the clock signal ϕX. Black is written to every fourth gate line (OUT7, OUT11, . . . ) in response to pulses CK2 of the clock signal OX. Namely, the gate output enable signal GOE is set to high level in response to the pulses CK1 and CK2, to write black to every fourth gate line (OUT3, OUT7, . . . ). The remaining gate lines (OUT2, OUT4 to OUT6, . . . ) are skipped in response to pulses CK3 of the clock signal ϕX, with the signal GOE being set to low level.

Figure 51:
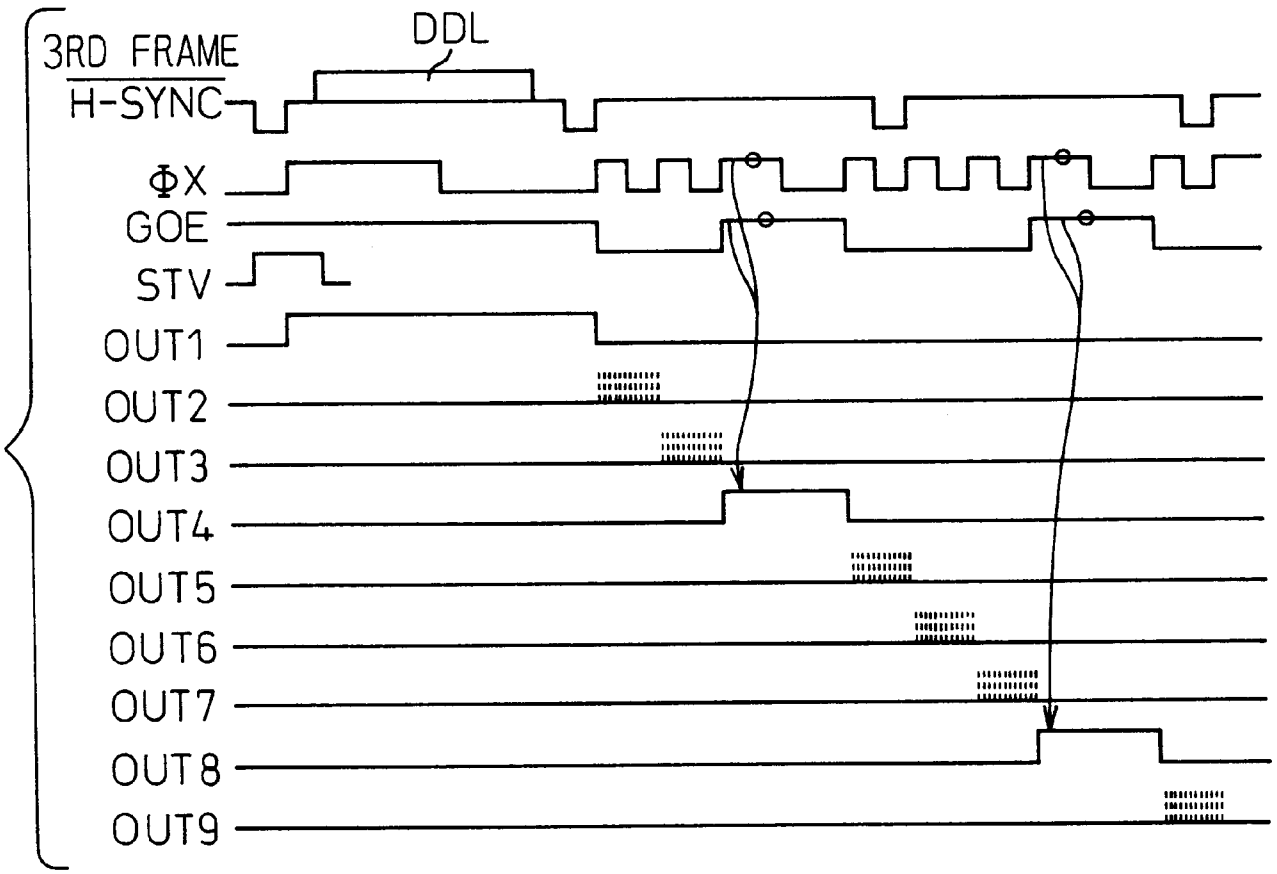
FIG. 51 is a timing chart (3) showing the operation of the same gate driver.
Figure 52:
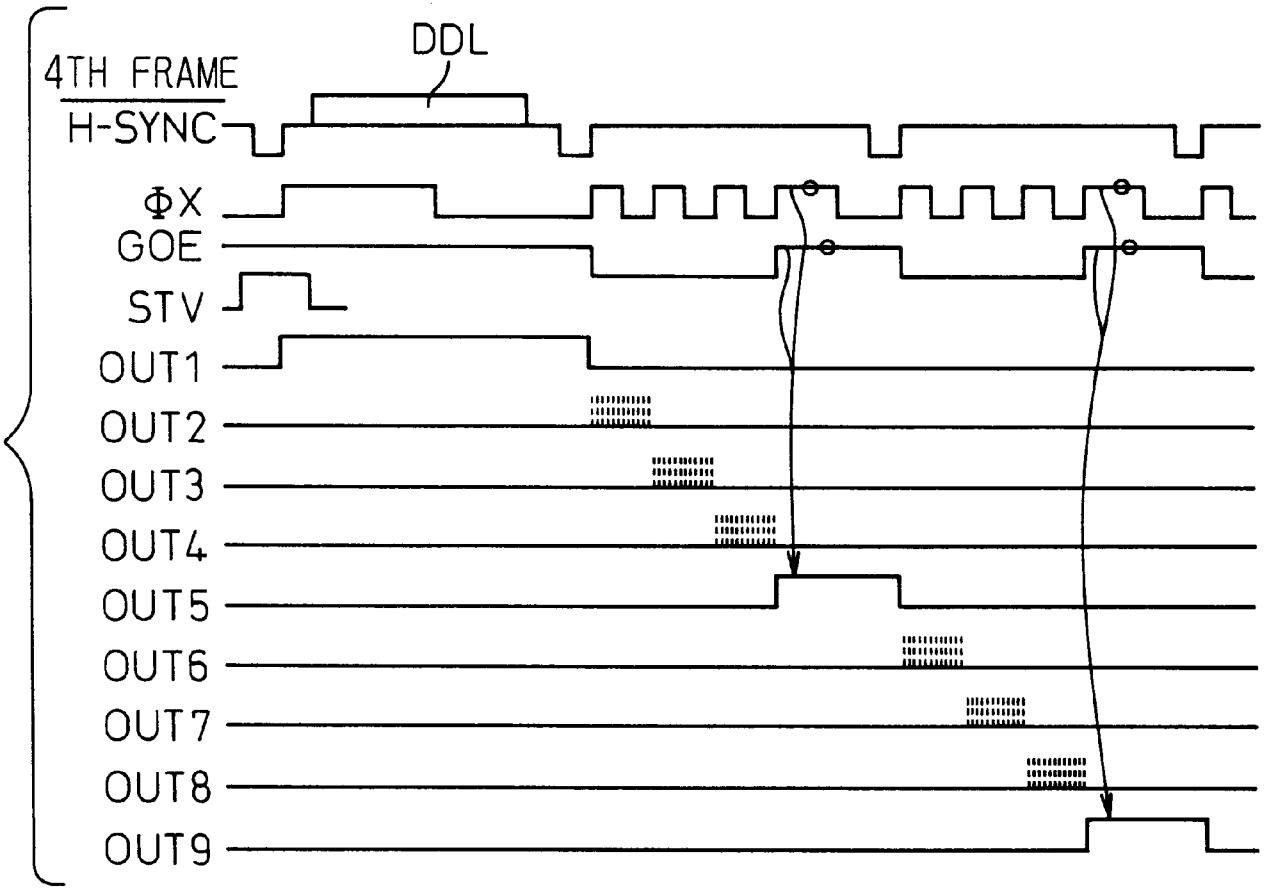
FIG. 52 is a timing chart (4) showing the operation of the same gate driver.

Similarly, in the third and fourth frames of FIGS. 51 and 52, black is written to the gate lines OUT4, OUT8, and the like where the image DI is not present according to the pulses CK2 of the clock signal ϕX.

In this way, this embodiment drives a gate line per horizontal scan period (H-SYNC) when the data driver 602 provides image data. During a period in which there is no image data, the embodiment drives a gate line per a plurality of horizontal scan periods. Namely, during the period having no image data, the embodiment inserts four pulses in each horizontal scan period, to shift the shift register 631 of the gate driver 603 by four gate lines. At this time, the gate output enable signal GOE is provided only for one of the four gate lines, so that the selected one gate line receives data and the remaining three gate lines receive no data.

In this way, the embodiment writes black to every fourth gate line, to drive all gate lines in four frames. The pulse CK2 used to display black in each gate line having no image data is relatively long but shorter than the pulse CK1 used to display image data, and the pulse CK3 used to skip gate lines is shorter than the pulse CK2. As a result, black is correctly written in four frames to every gate line in the bottom area of the panel 601 where there is no image data. Similarly, black is written to the top area of the panel 601 where the image DI is not present.

Figure 53:
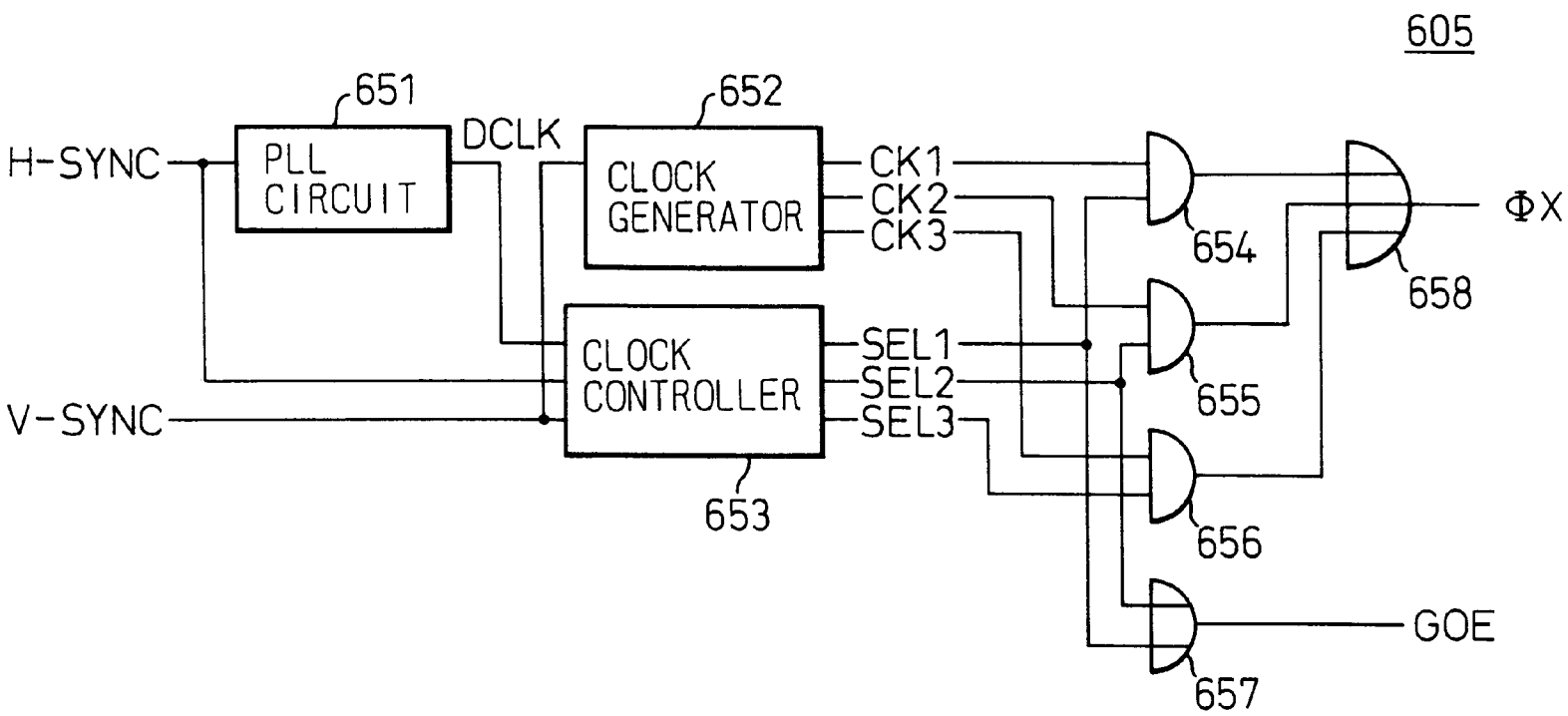
FIG. 53 shows a circuit for generating gate driver control signals of the LCD of FIG. 46.
Figure 54:
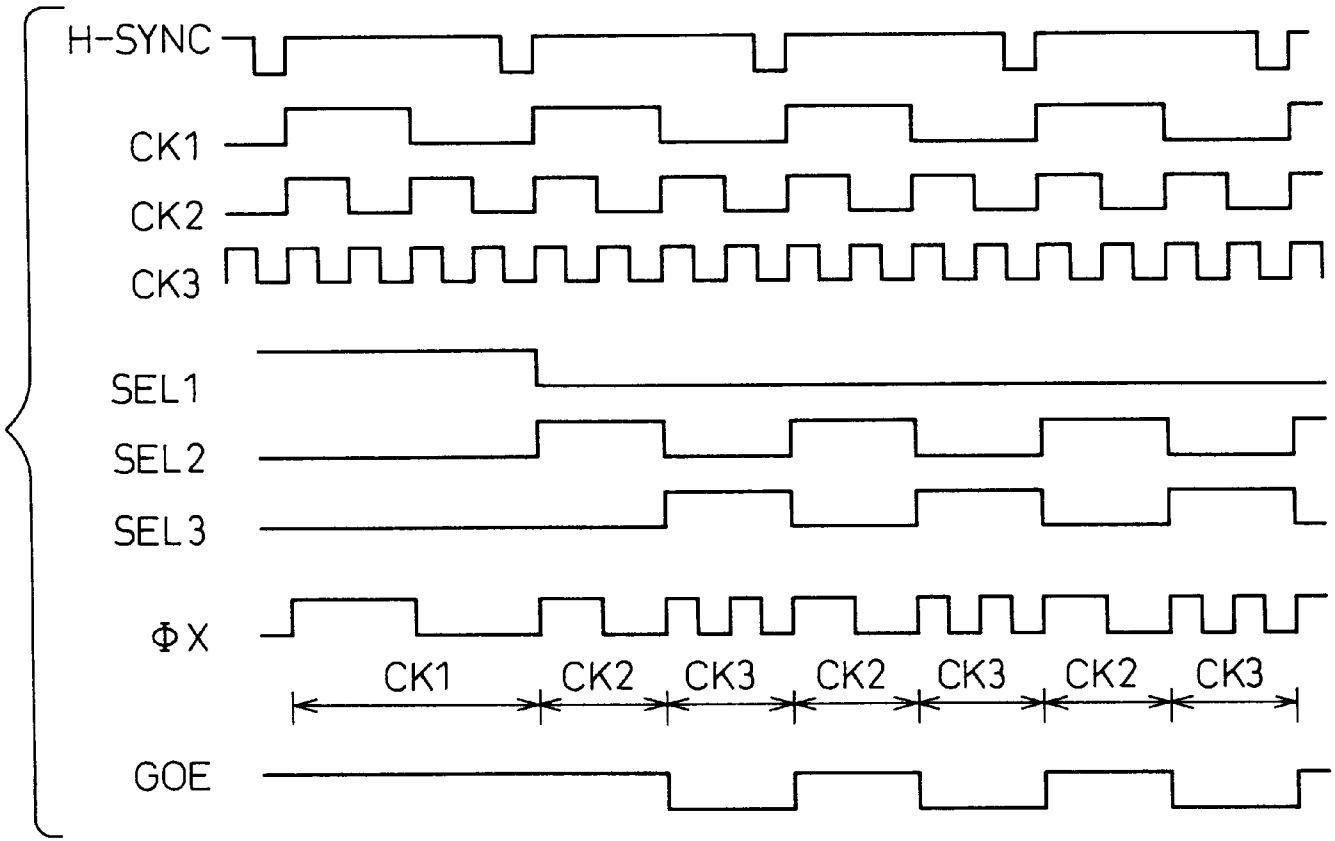
FIG. 54 is a timing chart showing the operation of the circuit of FIG. 53.

FIG. 53 shows a circuit for generating control signals for the gate driver 603, and FIG. 54 is a timing chart showing the operation of the circuit of FIG. 53.

The circuit is incorporated in the control signal generator 605 and consists of a PLL (phase locked loop) circuit 651, a clock generator 652, a clock controller 653, AND gates 654 to 656, and OR gates 657 and 658.

The clock generator 652 generates the pulse CK1 for a normal display period, the pulse CK2 for displaying black during a blanking period, and the pulse CK3 for skipping the shift register circuit 631 of the gate driver 603. The pulses CK1 to CK3 from the clock generator 652 are switched from one to another according to select signals SEL1 to SEL3 provided by the clock controller 653 according to the timing of display data.

The select signal SEL1 is set to high level to select the pulse CK1. The select signal SEL2 is set to high level to select the pulse CK2. The select signal SEL3 is set to high level to select the pulse CK3. The OR gate 657 forms the gate output enable signal GOE for controlling the output of the gate driver 603 according to an OR of the select signals SEL1 and SEL2, so that the gate driver 603 skips a gate line according to the pulse CK3.

Figure 55:
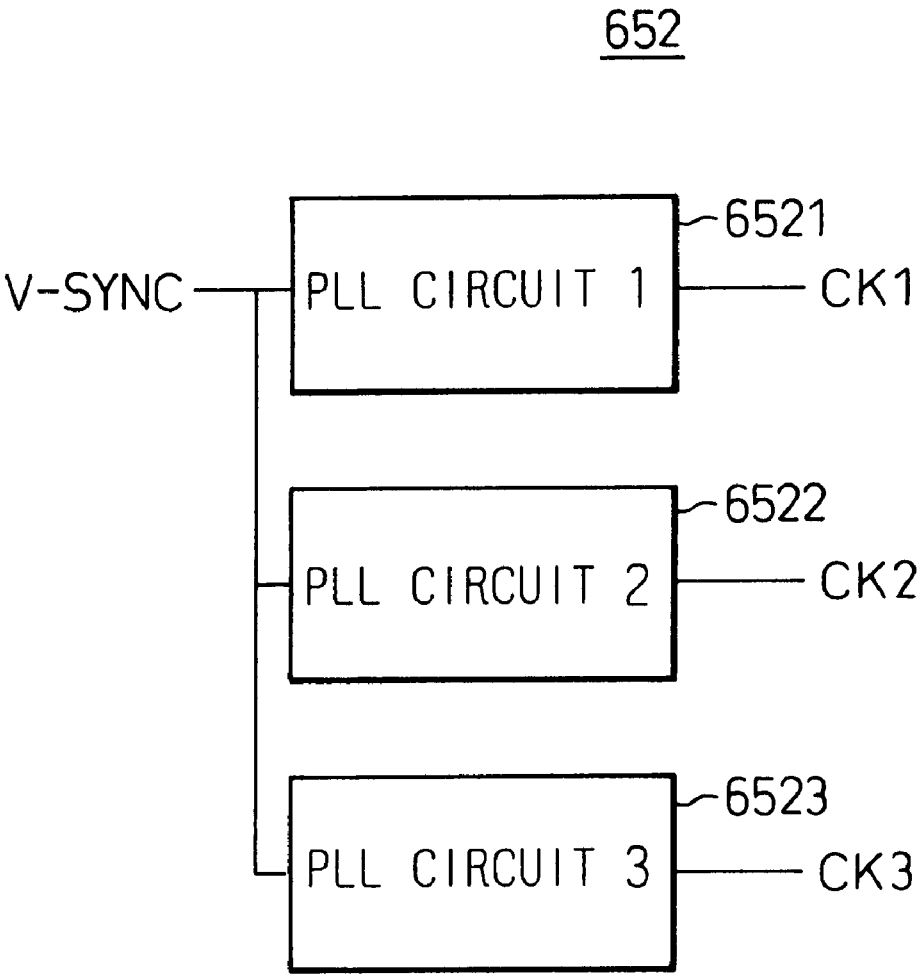
FIG. 55 is a block diagram showing a clock generator of the circuit of FIG. 53.

FIG. 55 is a block diagram showing the clock generator 652 of FIG. 53. The clock generator 652 consists of three PLL circuits 6521 to 6523, to generate the pulses CK1, CK2, and CK3 in synchronization with the vertical synchronous signal V-SYNC.

Figure 56:
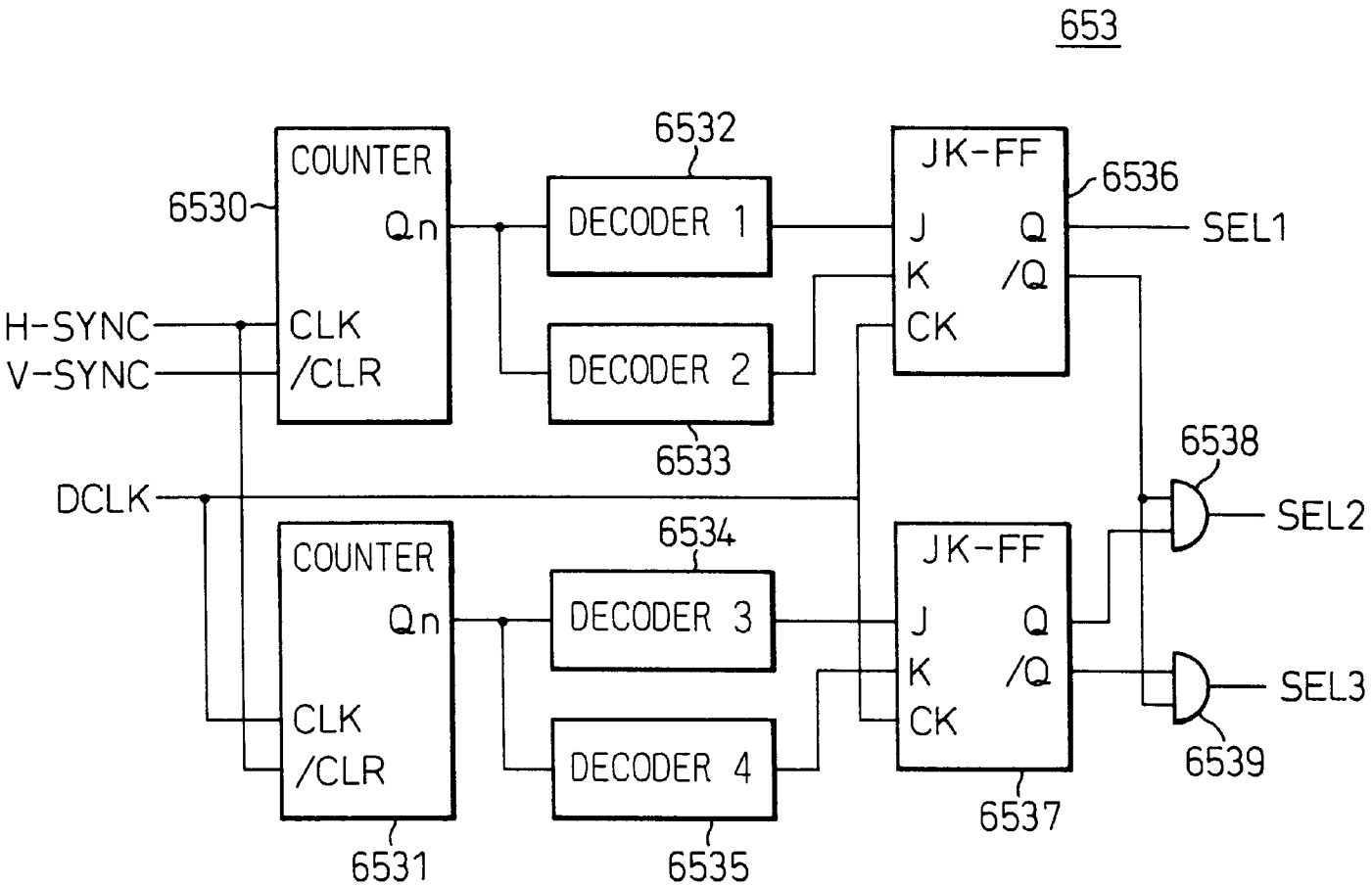
FIG. 56 is a block diagram showing a clock controller of the circuit of FIG. 53.

FIG. 56 is a block diagram showing the clock controller 653 of FIG. 53. The clock controller 653 consists of two counters 6530 and 6531, four decoders 6532 to 6535, two J–K flip-flops 6536 and 6537, and two AND gates 6538 and 6539.

The counter 6530 counts pulses of the horizontal synchronizing signal H-SYNC, and the counter 6431 counts pulses of a dot clock signal DCLK. The output of the counter 6530 is decoded by the decoders 6530 and 6533 whose outputs are supplied to J and K terminals of the flip-flop 6536. The output of the counter 6531 is decoded by the decoders 6534 and 6535 whose outputs are supplied to J and K terminals of the flip-flop 6537. A Q terminal of the flip-flop 6536 provides the select signal SELl. The AND gate 6538 provides the select signal SEL2 according to an AND of a/Q terminal of the flip-flop 6536 and a Q terminal of the flip-flop 6537. The AND gate 6539 provides the select signal SEL3 according to an AND of the/Q terminal of the flip-flop 6536 and a/Q terminal of the flip-flop 6537. Values decoded by the decoders 6532 to 6535 are changed frame by frame, so that the clock signal ϕX to the gate driver 603 has a period extending over a plurality of frames.

Figures 57A, 57B:
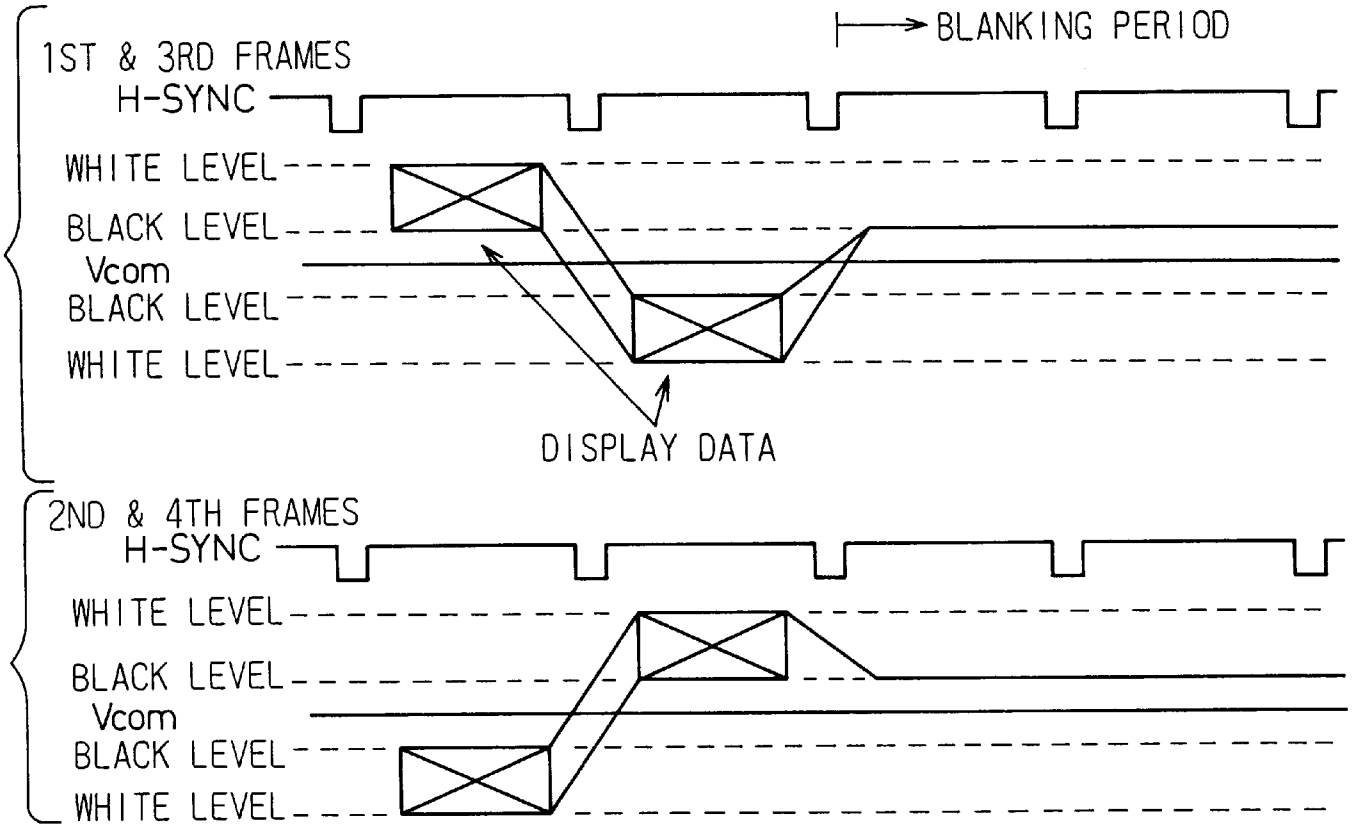
FIGS. 57A and 57B show the levels of display signals in the LCD of FIG. 46.
Figure 58A:
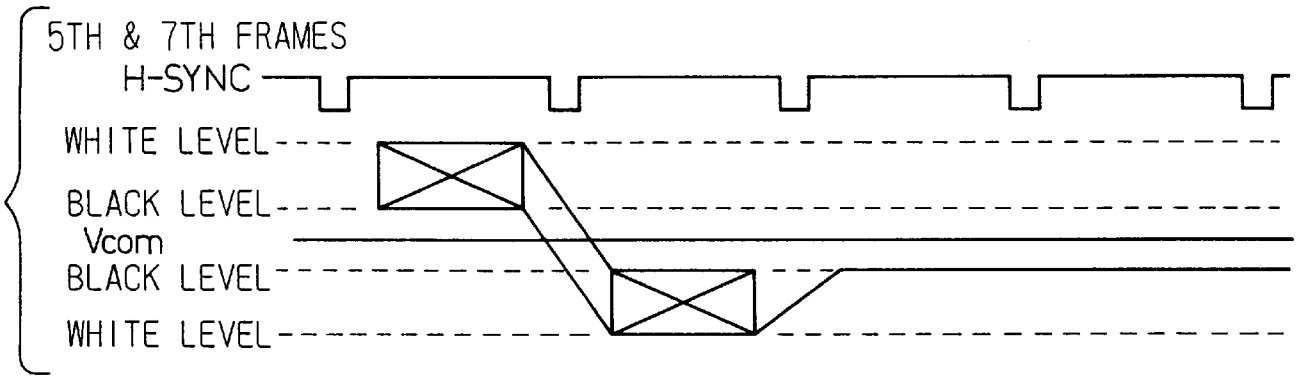
FIGS. 58A and 58B show the levels of display signals in the LCD of FIG. 46.
Figure 58B:
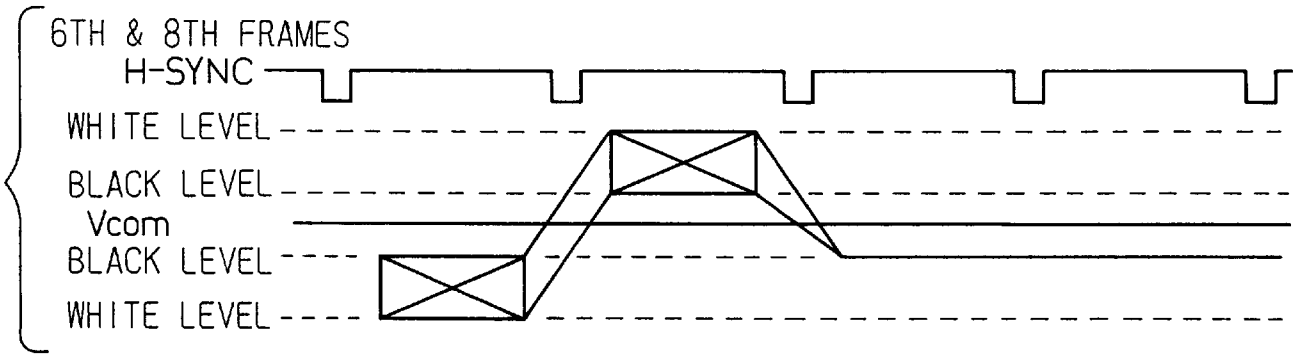

FIGS. 57A to 58B show the levels of display signals in the LCD of FIG. 46, in which FIG. 57A shows first and third frames, FIG. 57B second and fourth frames, FIG. 58A fifth and seventh frames, and FIG. 58B sixth and eighth frames. The period of the gate shifting clock signal ϕX is equal to four frames, and therefore, the period of the level of a display signal is equal to eight frames.

The polarity of display signals is inverted line by line during an image displaying period. During a blanking period, the polarity of a black signal is unchanged. Namely, in the first to fourth frames, the polarity of display signals is inverted line by line in each frame, and the polarity of the black signal during a blanking period is, for example, positive. In the fifth to eighth frames, the polarity of display signals is inverted line by line in each frame, and the polarity of the black signal during a blanking period is inverted to negative. Consequently, the polarity of display signals is inverted line by line and frame by frame. On the other hand, the polarity of the black signal is unchanged between lines and is inverted every four frames, to make the period thereof be eight frames. This technique helps keeping the quality of liquid crystals.

Figure 59:
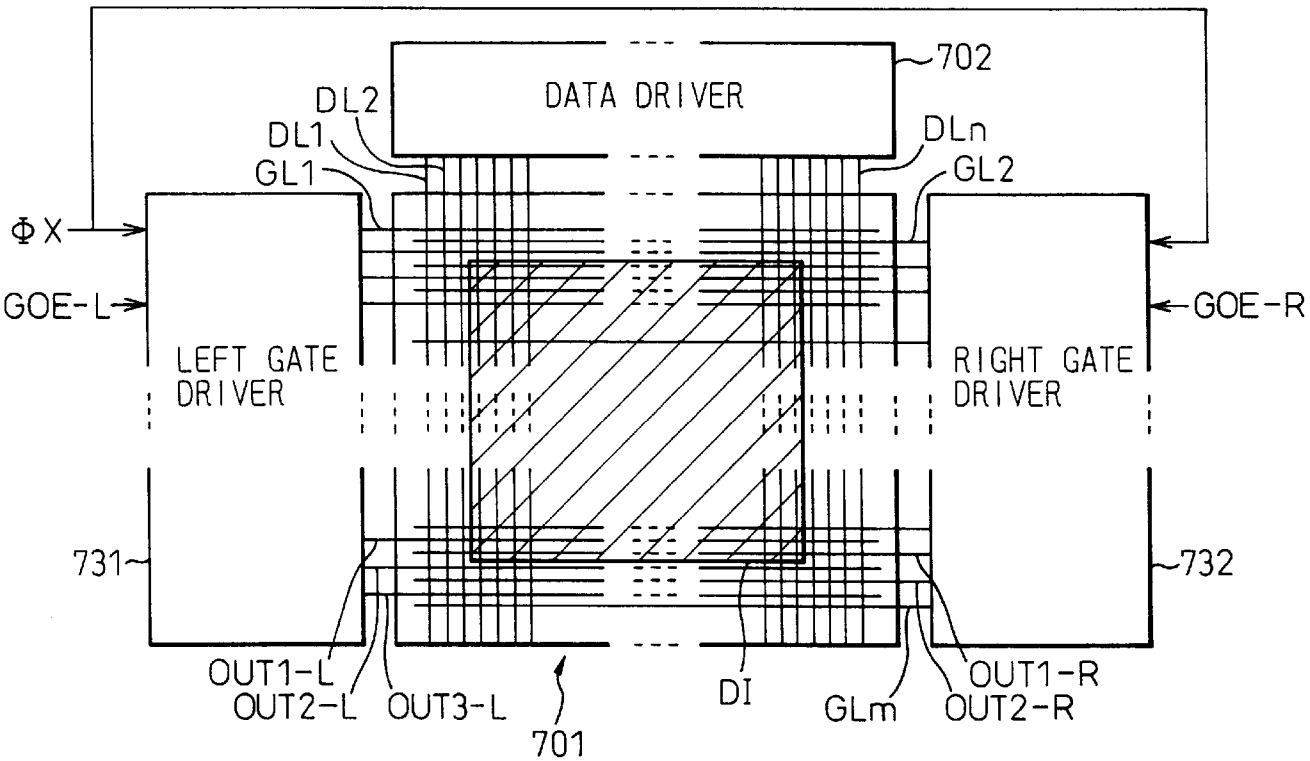
FIG. 59 shows connections between an LCD panel and drivers.

FIG. 59 shows connection between an LCD panel and drivers.

The panel 701 is driven by two gate drivers 731 and 732 arranged on each side of the panel 701. Gate lines (horizontal scan lines) driven by the gate driver 731 and those driven by the gate driver 732 are alternated. The outputs of a data driver 702 are connected to data lines DL1 to DLn of the panel 701. The outputs of the gate driver 731 are connected to odd gate lines GL1, GL3, GL5, and the like, and the outputs of the gate driver 732 are connected to even gate lines GL2, GL4, GL6, and the like.

FIGS. 60 to 63 are timing charts showing the operation of the gate drivers 731 and 732 of FIG. 59, according to a second embodiment of the fourth aspect of the present invention. These figures correspond to first to fourth frames, respectively.

The period of a pulse CK2' (CK1') of a gate shifting clock signal ϕX of FIGS. 60 to 63 is longer than the period of the pulse CK2 (CK1) of FIGS. 49 to 52 because of the two gate drivers 731 and 732.

Figure 60:
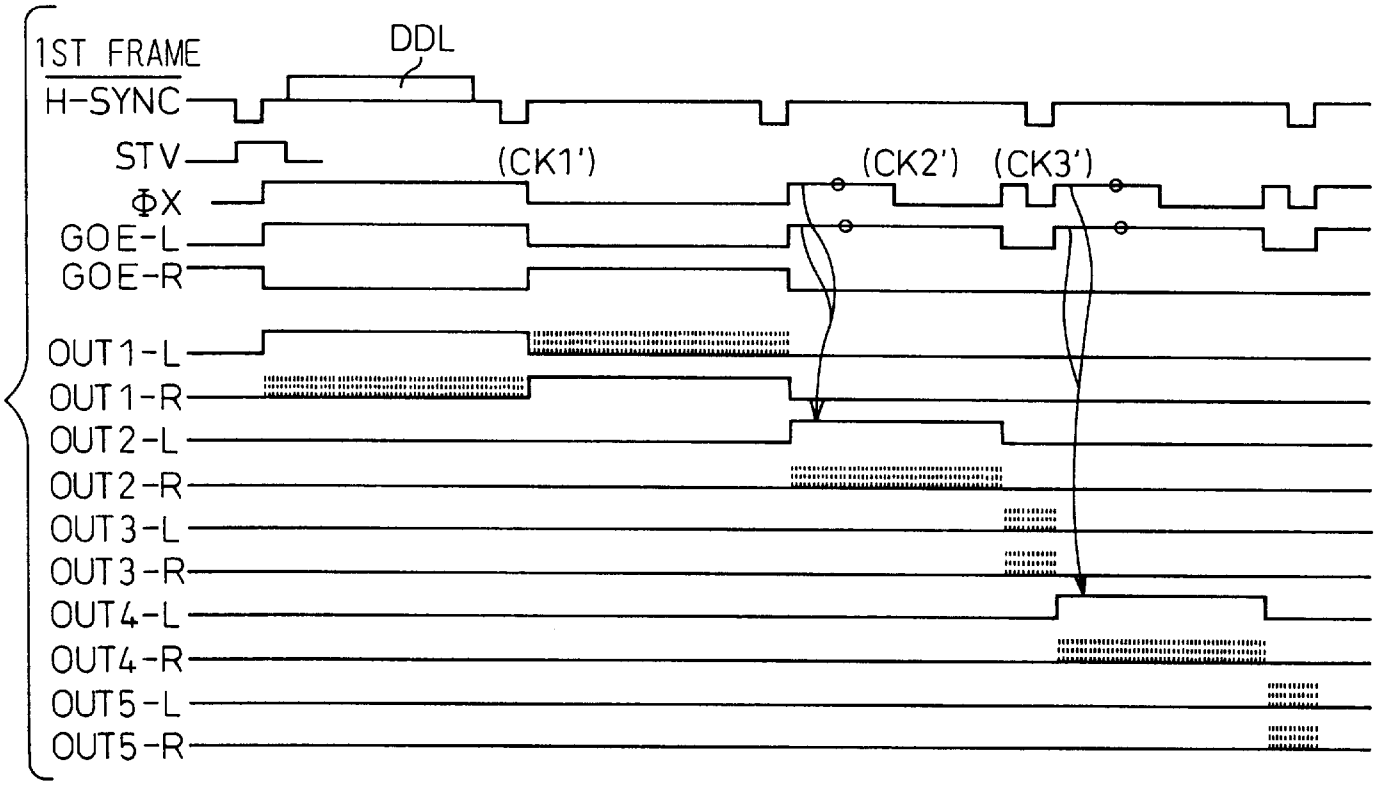
FIG. 60 is a timing chart (1) showing the operations of gate drivers of FIG. 59 according to a second embodiment of the fourth aspect of the present invention.

In the first frame of FIG. 60, last display data DDL for the first frame of an image DI displayed on an LCD panel 701 is written to gate lines (horizontal scan lines) OUT1-L and OUT1-R through the gate drivers 731 and 732 according to the pulse CK1' of the clock signal ϕX. The period of the pulse CK1' is about twice longer than that of the pulse CK1 of FIGS. 49 to 52. Black is written to the next gate line OUT2-L according to the pulse CK2'. Black is also written to every fourth gate line (OUT4-L, OUT6-L, . . . ) according to each pulse CK2'.

Output enable signals GOE-L and GOE-R for the gate drivers 731 and 732 are sequentially set to high level according to the pulses CK1' and CK2' of the clock signal (ϕX, to write black to every fourth gate line (OUT2-L, OUT4-L, etc.). The remaining gate lines (OUT2-R, OUT3-L, OUT3-R, OUT4-R, OUT5-L, OUT5-R, . . . ) are skipped by setting the signals GOE-L and GOE-R to low level according to each pulse CK3' whose period is shorter than that of the pulse CK2'. The pulse CK3' may be identical to the pulse CK3 of FIGS. 49 to 52.

Figure 61:
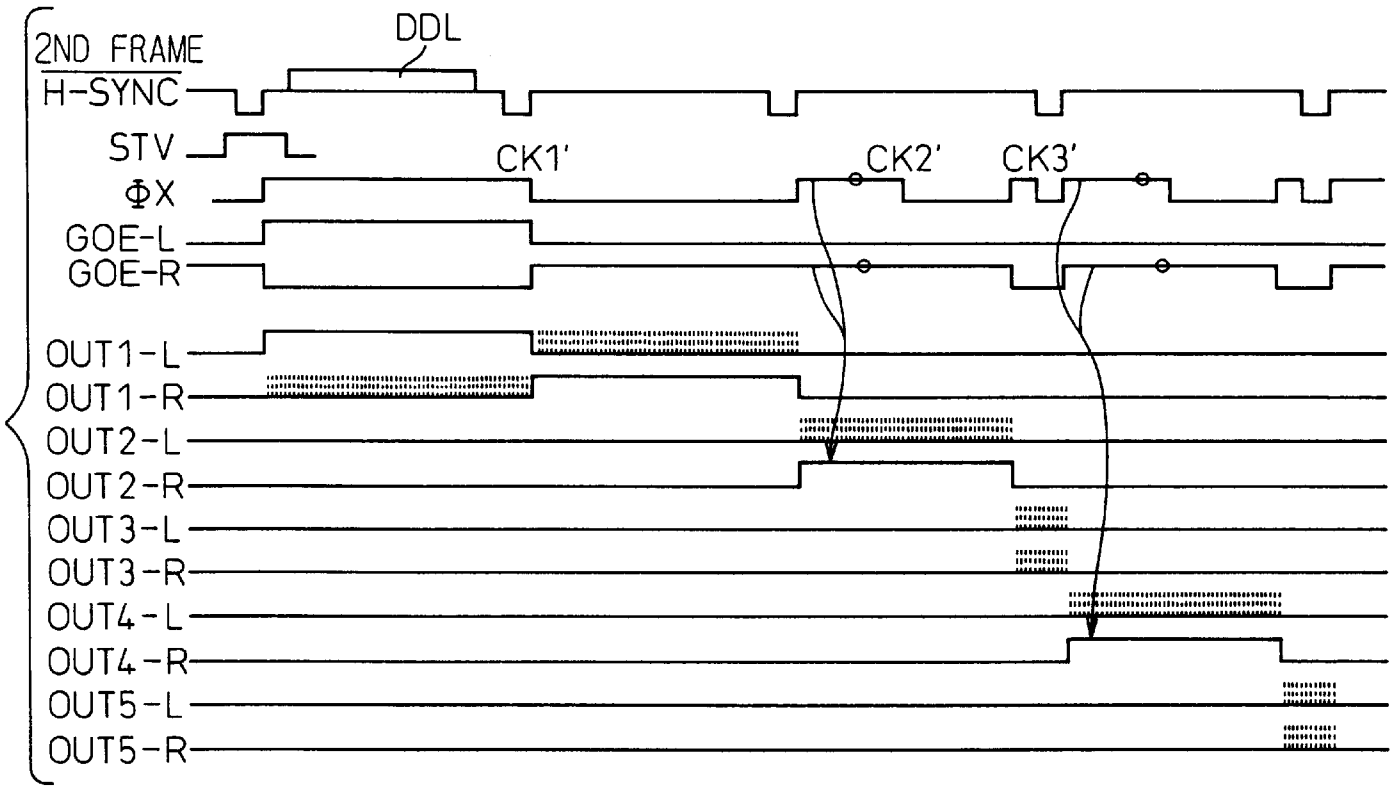
FIG. 61 is a timing chart (2) showing the operations of the same gate drivers.
Figure 62:
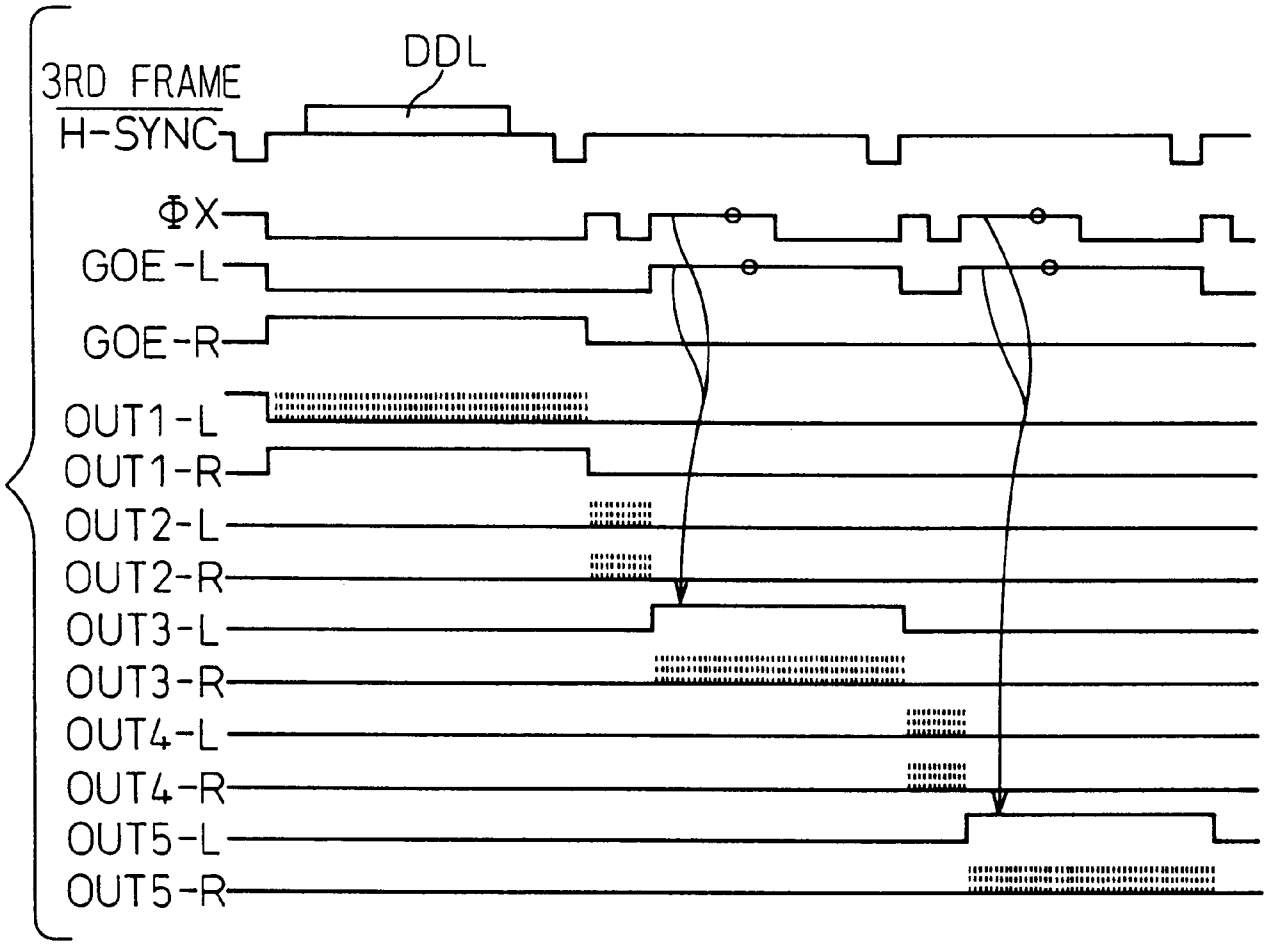
FIG. 62 is a timing chart (3) showing the operations of the same gate drivers.
Figure 63:
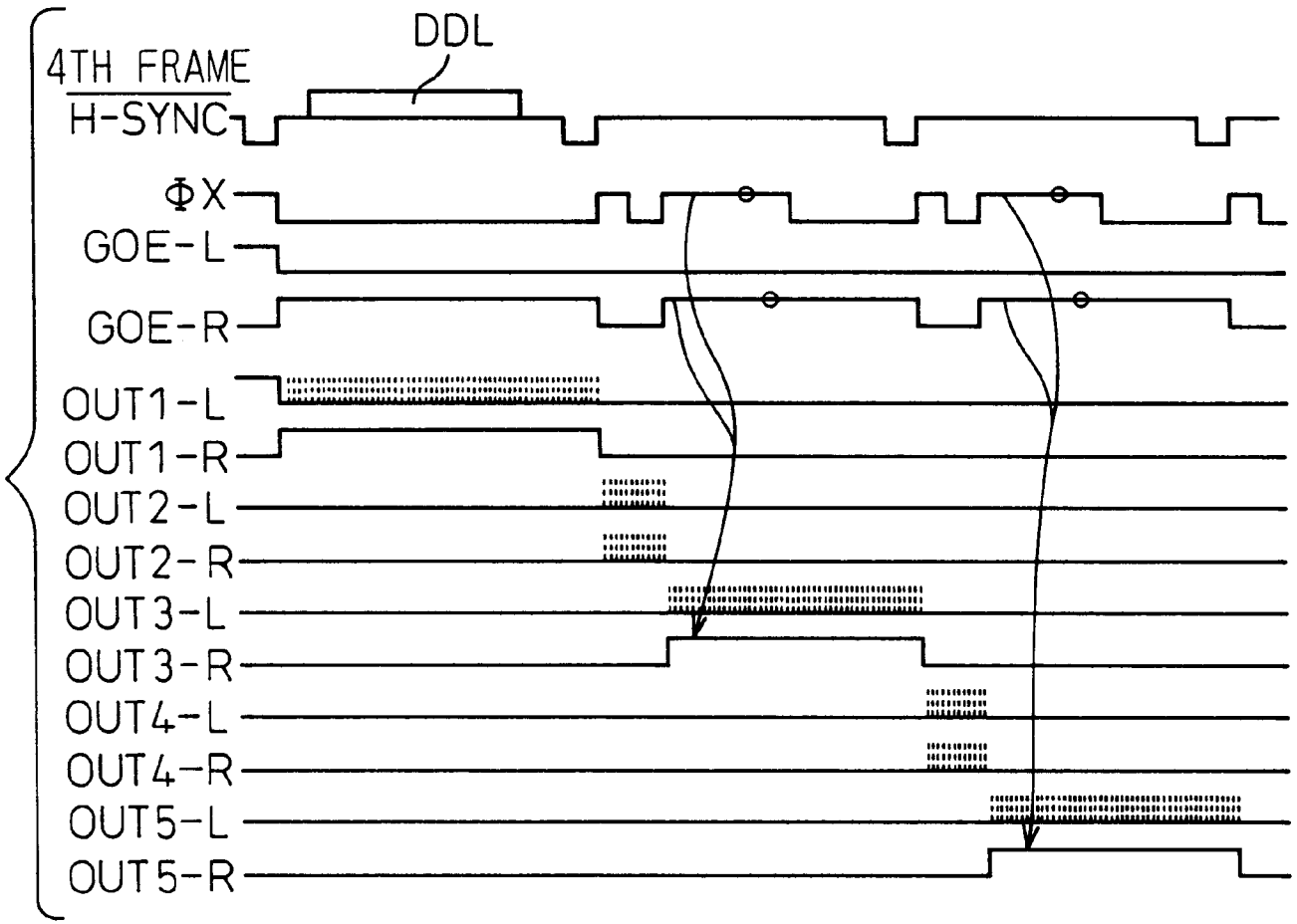
FIG. 63 is a timing chart (4) showing the operations of the same gate drivers.

The operations of the gate drivers 731 and 732 in the second to fourth frames of FIGS. 61 to 63 will be understood with reference to FIGS. 50 to 52.

Similar to the embodiment of FIGS. 49 to 52, the embodiment of FIGS. 61 to 63 writes black to every fourth gate line, so that all gate lines are driven in four frames. Since the latter employs the two gate drivers 731 and 732 for alternately driving odd and even gate lines, the period of the pulse CK2' of the clock signal ϕX of FIGS. 61 to 63 is about twice longer than that of the pulse CK2 of FIGS. 49 to 52. Namely, the embodiment of FIGS. 61 to 63 has a sufficient write time. Data to be written to the top, bottom, left, and right areas of the panel 701 where the image DI is not present is not limited to black. It may be blue or any other data. The polarity of image signals may be inverted as shown in FIGS. 57A to 58B.

As explained above, the fourth aspect of the present invention drives one of several gate lines in a blanking period. Namely, the fourth aspect generates several kinds of clock pulses in each horizontal period, to enable one of a plurality of gate lines and skip the remaining gate lines, so that all gate lines are driven in a plurality of frames. The fourth aspect reduces the frequency of the gate output enable signal GOE, to extend the period of the gate shifting clock signal $\phi X$. Since the width of a write pulse in a blanking period is wide, a sufficient write voltage is applied to liquid crystal cells. The fourth aspect may arrange gate drivers on each side of an LCD panel, to alternately drive gate lines (horizontal scan lines). This arrangement halves the frequency of the clock signal $\phi X$, to further widen the width of a write pulse during a blanking period. When displaying an image in its original size on an LCD panel whose size is larger than that of the image, the fourth aspect provides a sufficient write time even if a blanking period is short or even if there are many gate lines having no image data, to write some data that may not spoil the view to pixels having no image data.

As explained above, the present invention provides a display, a method of driving the display, and a circuit for driving the display, to properly display images of various sizes on the display.

Many different embodiments of the present invention may be constructed without departing from the spirit and scope of the present invention, and it should be understood that the present invention is not limited to the specific embodiments described in this specification, except as defined in the appended claims.

What is claimed is:

1. A display comprising:

a display panel having a first aspect ratio, capable of displaying an image of a second aspect ratio whose width element is larger than that of the first aspect ratio;

a gate drive for sequentially selecting gate lines of the display panel;

a data driver for storing display data for one gate line and supplying the display data to one of the gate lines selected by the gate driver; and a timing controller for supplying control signals to the gate driver and the data driver so that predetermined data is displayed in top and bottom non-image areas of the display panel during a vertical blanking period, a frequency of a clock signal used to sequentially select the gate lines being increased during the vertical blanking period from a value for usual display data to a value for the predetermined data.

2. A display as claimed in claim 1, wherein a frequency of the clock signal for the predetermined data is about two to four times higher than a frequency for usual display data.

3. A display as claimed in claim 1, wherein the timing controller writes the predetermined data simultaneously to the top and bottom non-image areas of the display panel during the vertical blanking period with the frequency of the clock signal being set to a low value.

4. A display as claimed in claim 1, wherein the timing controller writes the predetermined data to the data driver during the vertical blanking period in one latch operation.

5. A display as claimed in claim 1, wherein the first aspect ratio is 3:4 corresponding to a normal-size image, and the second aspect ratio is 9:16 corresponding to a wide-size image.

6. A display as claimed in claim 1, wherein the display further comprises an RGB driver for controlling red, green, and blue.

7. A display as claimed in claim 1, wherein the predetermined data corresponds to black.

8. A display as claimed in claim 1, wherein the display is a liquid crystal display.

9. A drive circuit of a display having a display panel of a first aspect ratio, capable of displaying an image of a second aspect ratio whose width element is larger than that of the first aspect ratio, a gate driver for sequentially selecting gate lines of the display panel, and a data driver for storing display data for one gate line and supplying the stored display data to one of the gate lines selected by the gate driver, comprising the function of:

supplying control signals to the gate driver and the data driver so that predetermined data is displayed in top and bottom non-image areas of the display panel during a vertical blanking period, a frequency of a clock signal used to sequentially select the gate lines being increased during the vertical blanking period from a value for usual display data to a value for the predetermined data.

10. A drive circuit as claimed in claim 9, wherein the frequency for the predetermined data is about two to four times higher than the frequency for usual display data.

11. A drive circuit as claimed in claim 9, wherein the predetermined data is written simultaneously to the top and bottom non-image areas of the display panel during the vertical blanking period with the frequency of the clock signal being set to a low value.

12. A drive circuit as claimed in claim 9, wherein the predetermined data is written to the data driver during the vertical blanking period in one latch operation.

13. A drive circuit as claimed in claim 9, wherein the first aspect ratio is 3:4 corresponding to a normal-size image, and the second aspect ratio is 9:16 corresponding to a wide-size image.

14. A drive circuit as claimed in claim 9, wherein the predetermined data corresponds to black.

15. A drive circuit as claimed in claim 9, wherein the display is a liquid crystal display.

16. A method ofdriving a display having a display panel of a first aspect ratio, to display on the display panel an image of a second aspect ratio whose width element is larger than that of the first aspect ratio, comprising the steps of:

writing predetermined data;

displaying the predetermined data written to the data driver in top and bottom non-image areas of the display panel during a vertical blanking period; and increasing, during the vertical blanking period, the frequency of a clock signal used to write display data from a value for usual display data to a value for the predetermined data.

17. A method of driving a display as claimed in claim 16, wherein the frequency for the predetermined data is about two to four times higher than the frequency for usual display data.

18. A method of driving a display as claimed in claim 16, wherein the method further comprises the step of writing the predetermined data simultaneously to the top and bottom non-image areas of the display panel during the vertical blanking period with the frequency of the clock signal being set to a low value.

19. A method of driving a display as claimed in claim 16, wherein the step of writing the predetermined data to a data driver during the vertical blanking period is carried out in one latch operation.

20. A method of driving a display as claimed in claim 16, wherein the first aspect ratio is 3:4 corresponding to a normal-size image, and the second aspect ratio is 9:16 corresponding to a wide-size image.

21. A method of driving a display as claimed in claim 16, wherein the predetermined data corresponds to black.

22. A method of driving a display as claimed in claim 16, wherein the display is a liquid crystal display.

* * * * *